US008186542B2

(12) United States Patent
Kobayashi et al.

(10) Patent No.: US 8,186,542 B2
(45) Date of Patent: May 29, 2012

(54) MEDICINE SUPPLY APPARATUS AND TABLET CASE

(75) Inventors: Koichi Kobayashi, Ota (JP); Manabu Haraguchi, Gunma-ken (JP); Akinori Hatsuno, Gunma-ken (JP); Toshitake Maruyama, Kumagaya (JP); Tetsuo Sakurai, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 12/285,654

(22) Filed: Oct. 10, 2008

(65) Prior Publication Data

US 2009/0045214 A1 Feb. 19, 2009

Related U.S. Application Data

(62) Division of application No. 11/337,681, filed on Jan. 24, 2006.

(30) Foreign Application Priority Data

Jan. 27, 2005 (JP) ..... 2005-019607
Jan. 27, 2005 (JP) ..... 2005-019625
Jan. 27, 2005 (JP) ..... 2005-019636

(51) Int. Cl.
*B65H 3/44* (2006.01)

(52) U.S. Cl. ..... 221/127; 221/124; 221/126; 221/172; 221/197

(58) Field of Classification Search ..... 221/172, 221/197, 123, 124, 126, 127
See application file for complete search history.

(56) References Cited

U.S. PATENT DOCUMENTS 2,786,566 A * 3/1957 Taggart et al. ..... 221/168
3,196,276 A * 7/1965 Naab ..... 250/223 R
4,741,428 A * 5/1988 Taniguchi et al. ..... 198/397.04
5,219,095 A * 6/1993 Shimizu et al. ..... 221/264
5,838,575 A * 11/1998 Lion ..... 700/231
5,873,488 A * 2/1999 Guerra ..... 221/220
6,085,938 A * 7/2000 Coughlin ..... 221/203
6,394,308 B1 * 5/2002 Yuyama et al. ..... 221/265
6,585,132 B2 * 7/2003 Kim ..... 221/133
6,592,005 B1 7/2003 Coughlin et al. ..... 221/129
7,344,049 B2 * 3/2008 Daniels et al. ..... 221/92

FOREIGN PATENT DOCUMENTS

GB 2244481 A * 12/1991 ..... 221/202
JP 63-144401 9/1988
JP 4-16731 2/1992

(Continued)

OTHER PUBLICATIONS

Japanese Office Action dated Oct. 13, 2009 in Japanese.

(Continued)

*Primary Examiner* — Timothy Waggoner
(74) *Attorney, Agent, or Firm* — Kratz, Quintos & Hanson, LLC

(57) ABSTRACT

An object is to provide a medicine supply apparatus capable of reducing a time required for charging medicines without causing any trouble during counting of the medicines, the apparatus comprises: a discharge drum which discharges the medicines from a tablet case; a medicine detecting sensor which detects the medicines discharged from the tablet case, and a control device, and this control device controls a rotating motor for rotating the discharge drum to discharge the medicines from the tablet case, counts the discharged medicines based on a detecting operation of the medicine detecting sensor, and changes a discharge speed of the medicine by the discharge drum depending on a type of medicine in the tablet case.

3 Claims, 20 Drawing Sheets

FOREIGN PATENT DOCUMENTS

| | | |
|---|---|---|
| JP | 7-289610 | 11/1995 |
| JP | 2001-204795 | 7/2001 |
| JP | 2001-269558 | 10/2001 |
| JP | 2002-505770 | 2/2002 |
| JP | 2002-80095 | 3/2002 |
| JP | 2003-237707 | 8/2003 |
| WO | WO 98/00813 | 1/1998 |

OTHER PUBLICATIONS

Japanese Office Action dated Jan. 19, 2010 in Japanese.

* cited by examiner

MEDICINE SUPPLY APPARATUS AND TABLET CASE

This application is a Divisional of prior application Ser. No. 11/337,681 filed on Jan. 24, 2006, the contents being incorporated herein by reference.

BACKGROUND OF THE INVENTION

The present invention relates to a medicine supply apparatus for filling a medicine bottle with medicines contained in a tablet case by a quantity designated by a prescription in a hospital, a dispensing pharmacy or the like.

Heretofore, medicines prescribed by a doctor are supplied to a patient by use of a medicine supply apparatus in a hospital or a dispensing pharmacy. That is, in this type of medicine supply apparatus, medicines (tablets, capsules, etc.) having a quantity described in a prescription are discharged one by one from a tablet case via a discharge drum to fill a medicine bottle.

In this case, a plurality of horizontally juxtaposed tablet cases are vertically stacked in stages. The medicine bottle is moved along the backside of the cases, conveyed to a predetermined tablet case, and filled with the medicines discharged from the tablet case (see U.S. Pat. Nos. 6,085,938 and 6,592,005).

In this case, the medicines discharged from the tablet case are detected by a sensor, and counted based on an output of this sensor to fill the medicine bottle with the quantity of the medicines designated by the prescription. Heretofore, any kind of medicine has been discharged at a similar speed. Moreover, this medicine discharge speed has been set at such a certain speed as to prevent any trouble in the detection by the sensor.

On the other hand, for example, when the medicine has a small size or a round shape, a time required for passing through the sensor shortens. Therefore, it is known that any trouble is not generated in the detection, even if the discharge speed is increased.

Moreover, the medicines discharged from the tablet case are detected by the sensor, and counted based on the output of this sensor to fill the medicine bottle with the quantity of medicines designated by the prescription, but the medicines sometimes overflow a container because the container is excessively small or for another reason.

Furthermore, when a tablet case capacity is enlarged, and the quantity of the medicines to be contained in the case increases (especially in a case where a height of the medicine increases), a load applied to the discharge drum disposed in a bottom part of the tablet case becomes remarkably large. Therefore, the trouble occurs in rotation of the discharge drum, and there is a problem that a discharge defect is caused. When the load increases, the discharge drum is to rotate while pushing the load, and the medicines are strongly thrust upwards by the discharge drum in the tablet case.

SUMMARY OF THE INVENTION

The present invention has been developed to solve such conventional technical problem, and an object thereof is to provide a medicine supply apparatus which can reduce a time required for filling a medicine bottle without generating any trouble in counting the medicines.

According to a first aspect of the present invention, a medicine supply apparatus which fills a container with medicines discharged from a tablet case comprises: discharge means for discharging the medicines from the tablet case; medicine detection means for detecting the medicines discharged from the tablet case; and control means for controlling the discharge means to discharge the medicines from the tablet case, counting the discharged medicines based on a detecting operation of the medicine detection means, and changing a discharge speed of the medicine by the discharge means depending on a type of medicine in the tablet case.

In the medicine supply apparatus of a second aspect of the present invention, the control means changes the discharge speed depending on a size and/or a shape of the medicine in the tablet case.

In the medicine supply apparatus of a third aspect of the present invention, the control means increases the discharge speed in a case where the medicine in the tablet case has a small size and/or a round shape.

In the medicine supply apparatus of a fourth aspect of the present invention, the control means slows down the discharge speed just before the counting of the medicines is completed.

In the first aspect of the present invention, in the medicine supply apparatus which fills the container with the medicines discharged from the tablet case, there are provided: the discharge means for discharging the medicines from the tablet case; the medicine detection means for detecting the medicines discharged from the tablet case; and the control means. This control means controls the discharge means to discharge the medicines from the tablet case, counts the discharged medicines based on the detecting operation of the medicine detection means, and changes the discharge speed of the medicine by the discharge means depending on the type of medicine in the tablet case. Therefore, the discharge speed is increased depending on the size and/or the shape of the medicine in the tablet case, for example, as in the second aspect of the present invention, or in the case where the medicine has the small size and/or the round shape, for example, as in the third aspect of the present invention. Consequently, a time required for charging the medicines can be shortened without causing any trouble during the counting based on the detecting operation by the medicine detection means.

Moreover, the discharge speed is slowed down just before the counting of the medicines is completed as in the fourth aspect of the present invention. Consequently, while shortening a medicine charging time, a counting precision can be improved.

Furthermore, an object of the present invention is to provide a medicine supply apparatus capable of avoiding in advance a disadvantage that medicines overflow a container during charging of the medicines.

According to a fifth aspect of the present invention, a medicine supply apparatus which fills a container with medicines discharged from a tablet case comprises: means for detecting that the medicines are to overflow the container.

In a sixth aspect of the present invention, the medicine supply apparatus comprises: discharge means for discharging the medicines from the tablet case; medicine detection means disposed right above an upper opening of the container to detect the medicines discharged from the tablet case; control means; and alarming means, this control means controlling the discharge means to discharge the medicines from the tablet case, counting the discharged medicines based on a detecting operation of the medicine detection means, and judging that the medicines are to overflow the container to operate the alarming means in a case where the medicine detection means continuously detects the medicines.

In the medicine supply apparatus of a seventh aspect of the present invention, the control means stops the discharging of the medicines by the discharge means in a case where the medicine detection means continuously detects the medicines.

In the fifth aspect of the present invention, in the medicine supply apparatus which fills the container with the medicines discharged from the tablet case, there is provided the means for detecting that the medicines are to overflow the container. Therefore, it is possible to prevent the disadvantage that the medicines overflow the container for a certain cause.

Especially, as in the sixth aspect of the present invention, there are provided: the discharge means for discharging the medicines from the tablet case; the medicine detection means disposed right above the upper opening of the container to detect the medicines discharged from the tablet case; the control means; and the alarming means. This control means controls the discharge means to discharge the medicines from the tablet case, counts the discharged medicines based on the detecting operation of the medicine detection means, and judges that the medicines are to overflow the container to operate the alarming means in the case where the medicine detection means continuously detects the medicines. Accordingly, it is possible to prevent the overflowing by use of the medicine detection means for counting the medicines discharged from the tablet case.

Moreover, since the alarming means is operated to raise an alarm in a case where it is judged that the medicines are to overflow, an operator can be urged to quickly handle the situation.

Furthermore, when the discharging of the medicines by the discharge means is stopped in the case where the medicine detection means continuously detects the medicines as in the seventh aspect of the present invention, it is possible to securely prevent the disadvantage that the medicines overflow.

In addition, an object of the present invention is to provide a tablet case capable of reducing loads applied to a discharge drum even in a case where a capacity increases.

According to an eighth aspect of the present invention, a tablet case which contains medicines comprises: a storage container in which the medicines are stored; a discharge drum which is disposed in a bottom part of the storage container and which rotates; and a partitioning member which is disposed in the storage container and which vertically partitions the inside of the storage container while permitting passage of the medicines.

The tablet case of a ninth aspect of the present invention further comprises: a lid which openably closes an opening of the storage container; and a locking mechanism which retains a closed state of this lid.

In the eighth aspect of the present invention, in the tablet case which contains the medicines, there are provided: the storage container in which the medicines are stored; the discharge drum which is disposed in the bottom part of the storage container and which rotates; and the partitioning member which is disposed in the storage container and which vertically partitions the inside of the storage container while permitting the passage of the medicines. Therefore, most of the loads applied by the medicines of an upper part are received by the partitioning member. Accordingly, the loads applied to the discharge drum are reduced, a rotation defect (a defect in discharging the medicines) is prevented from being generated, and thrust-up can be reduced.

Moreover, according to the ninth aspect of the present invention, since there are additionally provided: the lid to openably close the opening of the storage container; and the locking mechanism to retain the closed state of this lid, it is possible to prevent a disadvantage that the lid is inadvertently opened during handling such as attaching/detaching.

DETAILED DESCRIPTION OF THE PREFERRED EMBODIMENT

Figure 1:
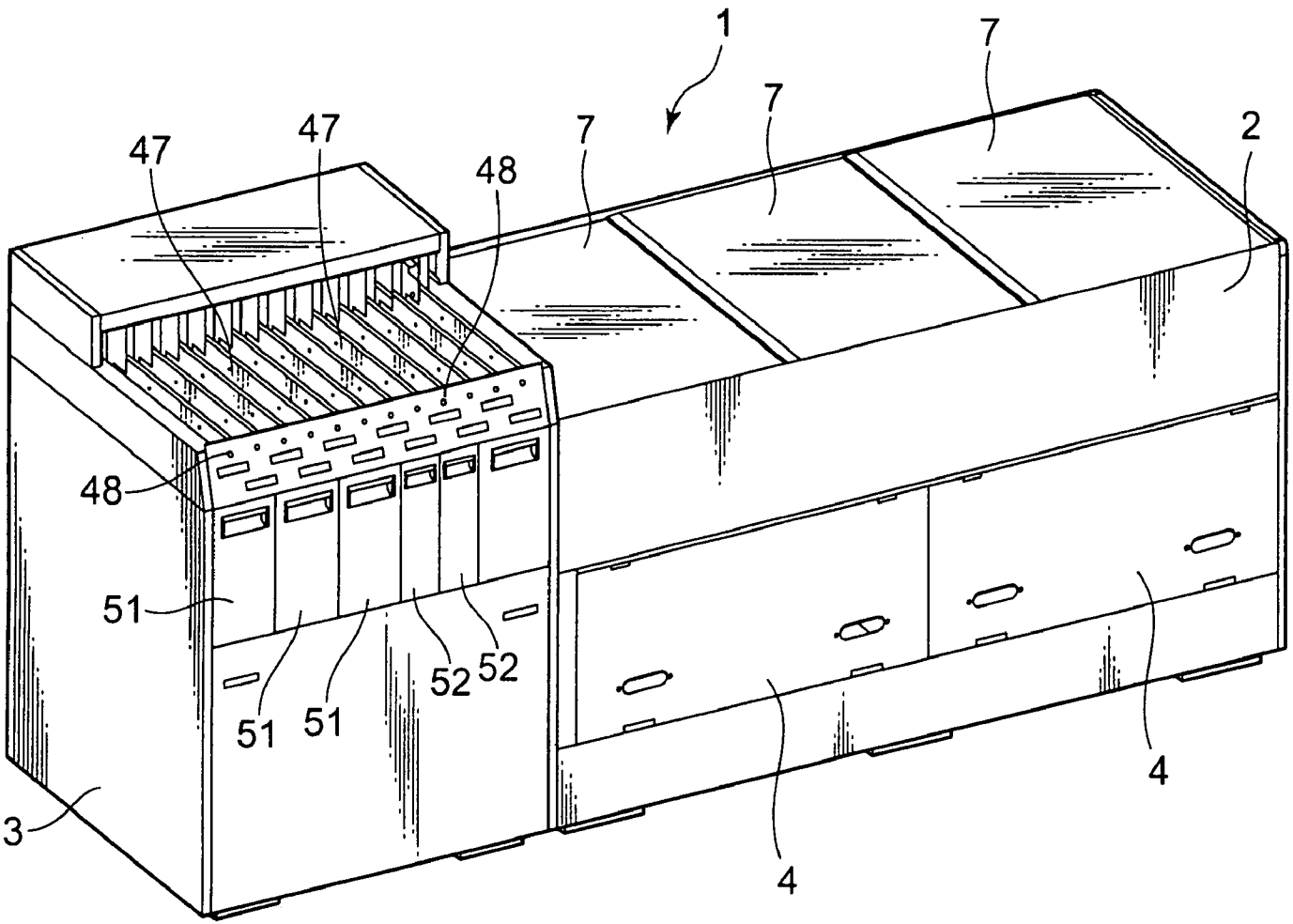
FIG. 1 is a perspective view of a medicine supply apparatus in an embodiment to which the present invention is applied.

There will be described hereinafter one embodiment of the present invention in detail with reference to the drawings.

In the embodiment, a medicine supply apparatus 1 is installed in a hospital, a dispensing pharmacy or the like to fill a medicine bottle with a medicine designated by a doctor's prescription and provide a person who is to be provided, such as a patient. The apparatus is generally constituted of: a charging unit 2 having a rectangular shape; and a providing unit 3 (providing means) similarly having a substantially rectangular shape and connected to the left of the charging unit 2 as one faces in a state in which the insides of the units communicate with each other.

(1) Charging Unit 2

First, a structure of the charging unit 2 will be described. A height dimension of the charging unit 2 is in a range of, for example, 900 mm to 1000 mm, and the unit is approximately as high as a usual table. A width of the unit is in a range of 1600 mm to 1700 mm, and a depth thereof is in a range of 800 mm to 900 mm. The front of this charging unit 2 is closed with openable panels 4, and a case containing section 6 is constituted in an upper part of the charging unit 2. The top of this case containing section 6 opens, and this upper opening is openably closed with top tables 7 which are removably disposed or one-side-rotatably supported. The top tables 7 have predetermined strengths so that articles (medicines contained in a carton case and the like) for use in the hospital or the dispensing pharmacy can be laid on the tables.

Figure 8:
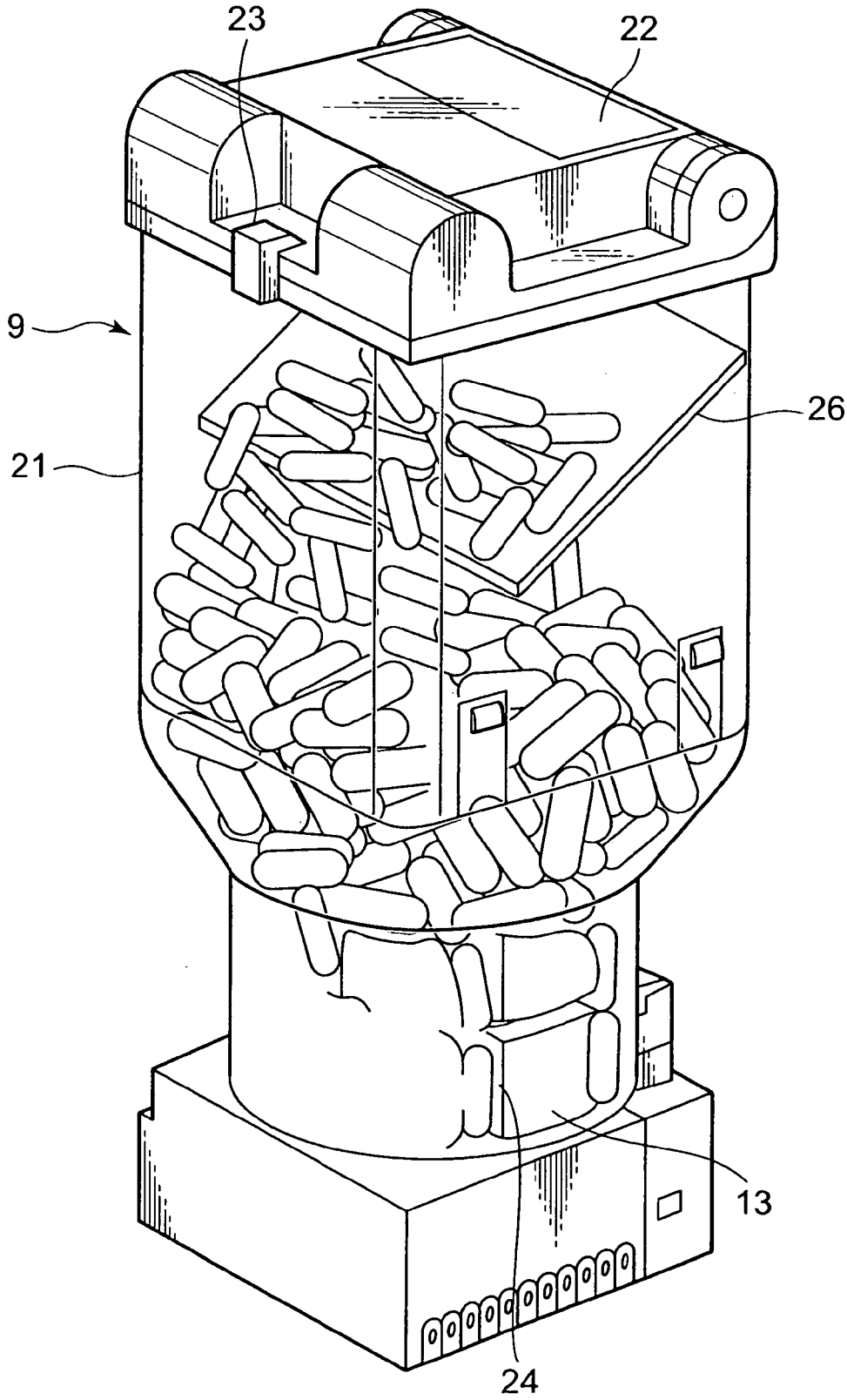
FIG. 8 is a perspective view of a tablet case.

An attaching plate 11 for attaching tablet cases 9 shown in FIG. 8 onto one plane is attached to the bottom of this case containing section 6. To this attaching plate 11, there are attached 200 attaching bases 12 shown in FIG. 11 for attaching one stage of 200 tablet cases 9 in total of 20 columns×10 rows. An engaging shaft 14 (constituting discharge means) is protruded from the top of each of the attaching bases 12 . . . to engage with a discharge drum 13 (discharge means) of the tablet case 9 described later. This engaging shaft 14 extends to the bottom of the attaching base 12, and an engagement gear 16 (constituting the discharge means) is attached to a lower end portion of the shaft.

Moreover, the attaching base 12 is provided with a chute 17 protruding right downwards and having a rectangular sectional shape, and upper and lower ends of the chute 17 open. Furthermore, each of the attaching bases 12 . . . is provided with a tablet case sensor 18 (shown in FIG. 20, detection means) for detecting whether or not the tablet case 9 is attached to the attaching base 12.

Figure 6:
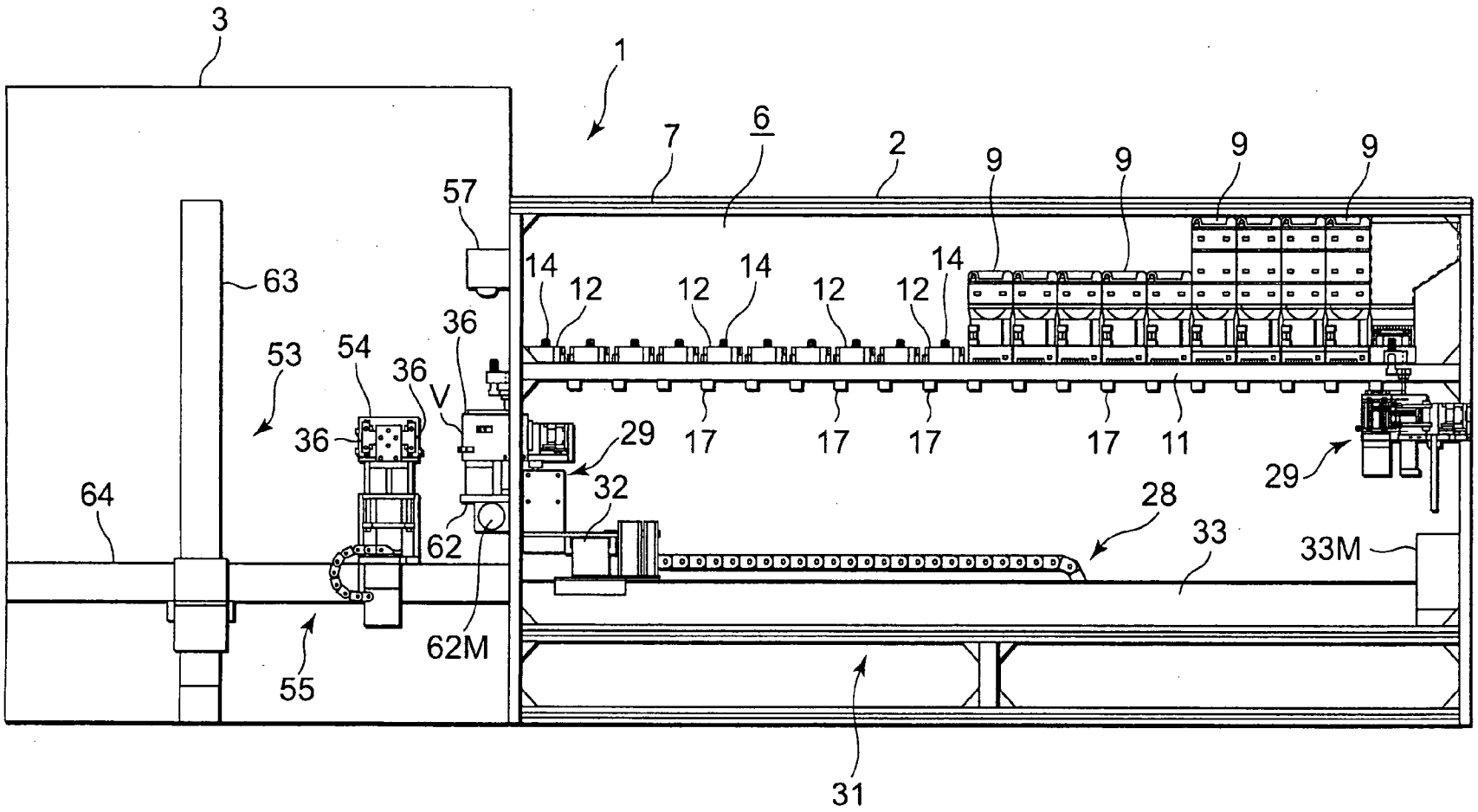
FIG. 6 is similarly a plan view.
Figure 7:
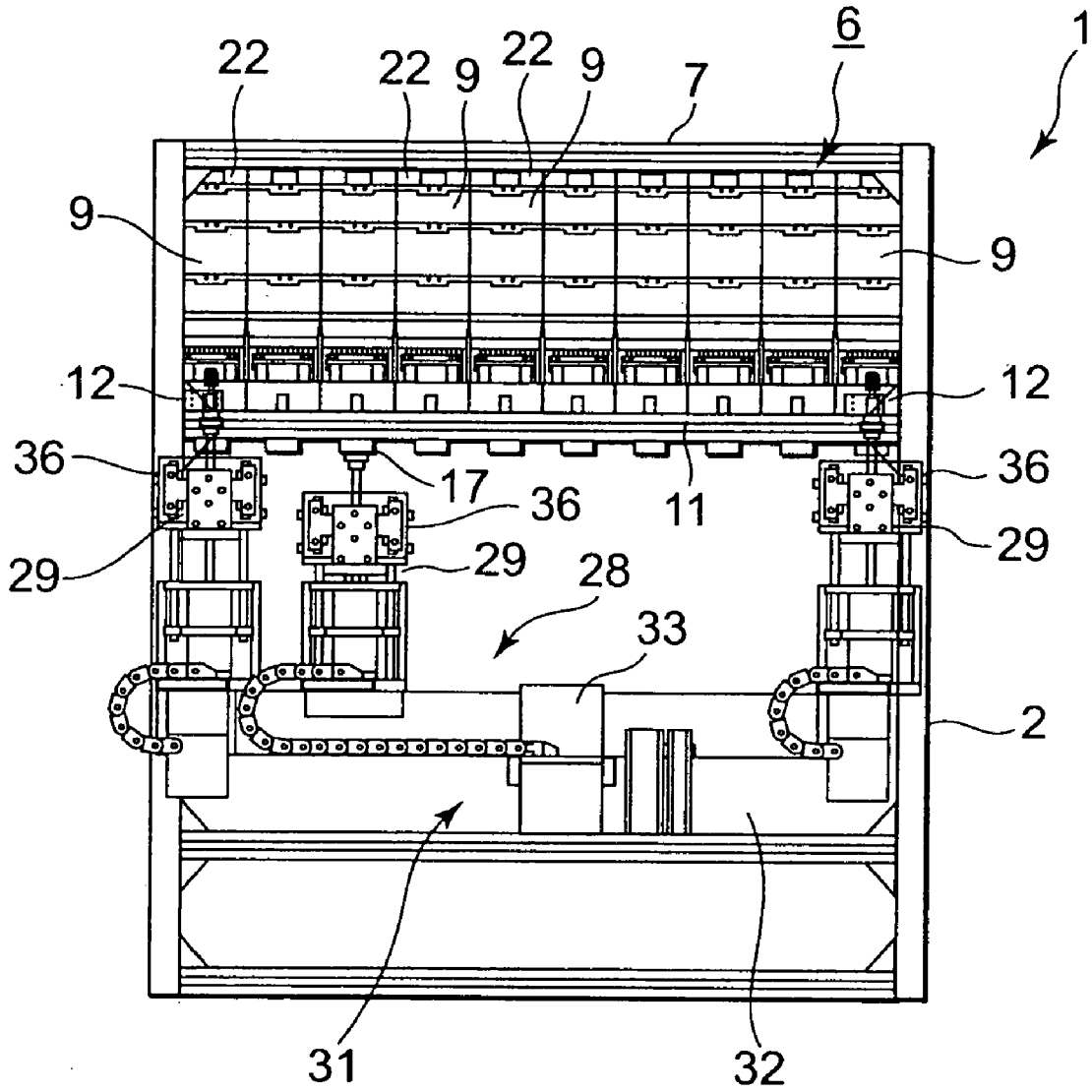
FIG. 7 is similarly a side view.

The tablet case 9 is constituted of a storage container 21 as shown in FIG. 8, and two types of storage containers 21, that is, short and long containers are prepared in the embodiment as shown in FIG. 6. Moreover, the height dimension of the case containing section 6 is set such that the tablet cases 9 constituted of the high storage containers 21 can be attached. The top of the storage container 21 opens, and this opening is openably closed with a lid 22 whose one side is rotatably supported. Accordingly, the medicine can be thrown and replenished into the storage container 21 of the tablet case 9 from above.

Moreover, a manual lock (locking mechanism) 23 for retaining the closed state of the lid 22 is disposed on an upper opening edge of the storage container 21 on a non-supported side of the lid 22. Accordingly, considerations are taken so as to prevent the lid 22 from being inadvertently opened, when the tablet case 9 is lifted up to be removed. In the bottom part of the storage container 21, the discharge drum 13 is attached via which the medicines drop downwards one by one. A plurality of vertical grooves 24 are formed at predetermined intervals in a side periphery of this discharge drum 13. When the lock 23 is unlocked, and the lid 22 is opened to throw/charge the medicine via the upper opening of the storage container 21, the medicine enters the vertical groove 24 of the discharge drum 13. Moreover, the discharge drum 13 is rotated as described later to match the vertical groove 24 with a portion of the attaching base 12 above the chute 17, the contained medicines naturally drops into the chute 17 one by one.

In this case, in a substantially intermediate height position of the storage container 21 in a vertical direction, a partition member 26 is attached which obliquely tilts downwards from one wall (on the supported side of the lid 22 in the embodiment) toward the other wall. A tip of this partition member 26 faces the other wall with a gap capable of passing the medicine. Accordingly, the inside of the storage container 21 is vertically partitioned in a state in which the medicine thrown from the upper opening is allowed to pass downwards from the partition member 26 to the discharge drum 13 via the tip of the member.

Here, especially in the long tablet case 9 of the storage container 21, since the quantity of the contained medicine is large, a large load is applied to the discharge drum 13, and such load of the medicine generates a trouble in the rotation of the discharge drum 13. The discharge drum 13 which is to rotate thrusts upwards hard. However, when the inside of the storage container 21 is vertically partitioned by the partition member 26 in this manner, most of the load applied by the medicine above is received by the partition member 26. Therefore, the load applied to the discharge drum 13 is reduced, a rotation defect (medicine discharge defect) is prevented from being generated, and the thrust-up can be reduced.

Moreover, to attach such tablet case 9 to the attaching base 12, the top table 7 is opened, and the tablet case is detachably attached to the attaching base 12 from above. In this case, the upper end portion of the engaging shaft 14 of the attaching base 12 engages with the discharge drum 13 from below, and the rotating force is transmitted to the discharge drum 13. The tablet case sensor 18 turns on when the tablet case 9 is attached to the sensor, and turns off when the case is not attached. To replenish the storage container 21 with the medicine, the top table 7 is similarly opened to unlock the lock 23 of the tablet case 9, and the lid 22 is opened to charge the medicine into the storage container 21 from above. That is, according to such constitution, the medicine can be replenished in a state in which the tablet case 9 is attached to the attaching base 12. Therefore, the tablet case 9 can be replenished with the medicine while filling a medicine bottle V described later with the medicine.

Figure 9:
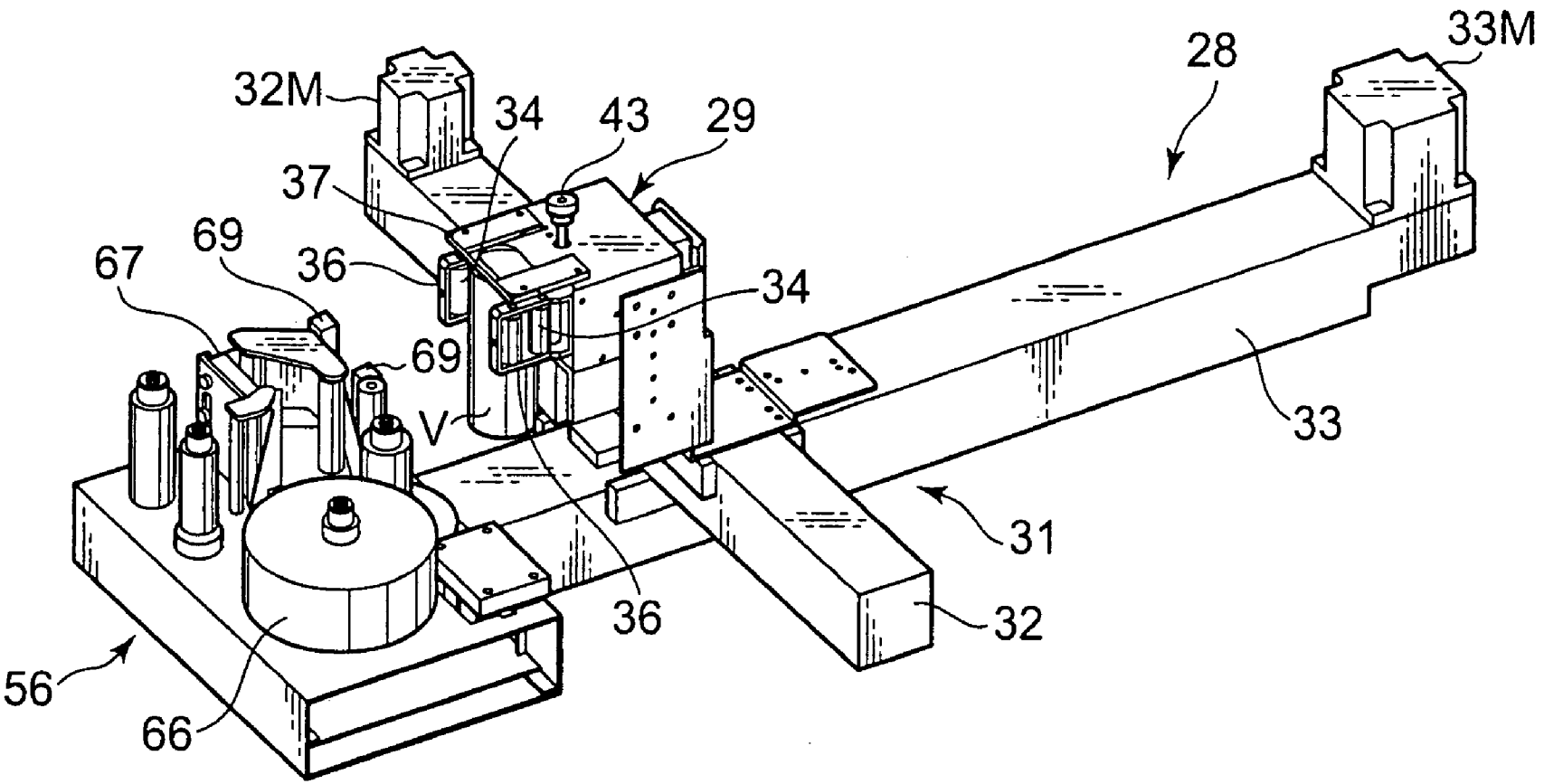
FIG. 9 is a perspective view showing a conveying device in a charging device and a label attaching device in a providing device.
Figure 10:
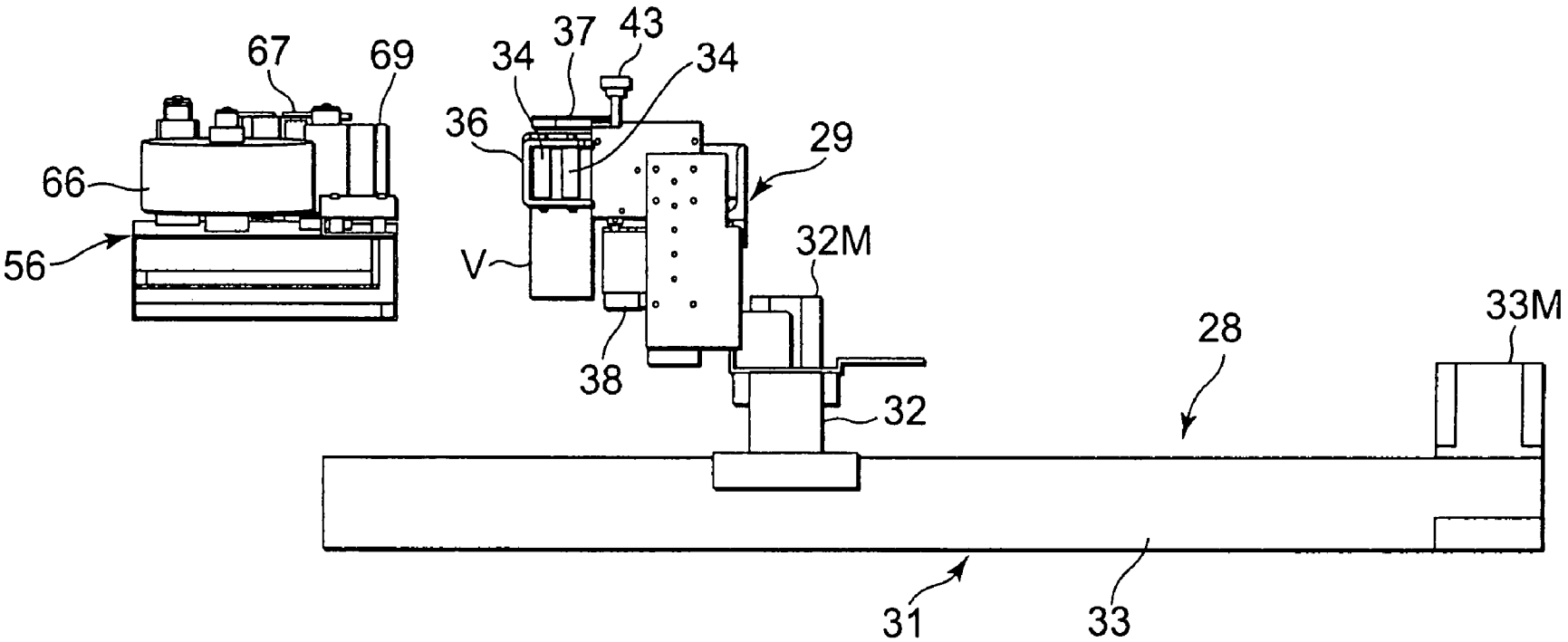
FIG. 10 is a front view of FIG. 9.

Furthermore, a charging device 28 (charging means) is disposed under the case containing section 6 in a lower part of the charging unit 2. This charging device 28 is constituted of: a holding device 29 (charging medicine bottle holding means) for holding the medicine bottle V; and a conveying device (charging conveyance means) 31 for conveying and disposing this holding device 29 and the medicine bottle V held by the device under the predetermined tablet case 9. As shown in FIGS. 9 and 10 in an extracted manner, this conveying device 31 is constituted of: a rail 32 horizontally disposed in a longitudinal direction (depth direction, X-axis); and a rail 33 for horizontally moving this rail 32 in a lateral direction (Y-axis), and motors 32M, 33M for conveyance are attached to end portions of the respective rails 32, 33. The motors 32M, 33M drive the rails to move the holding device 29 (medicine bottle V) along an X-Y axis in a horizontal direction under the tablet cases 9 . . . disposed in the case containing section 6. The holding device is disposed under the predetermined tablet case 9, and thereafter moved. It is to be noted that the motor 33M is positioned in an end portion of the lower part of the charging unit 2 on a side opposite to the providing unit 3. The tablet case 9 whose lateral size is twice that of the storage container 21 (doubled in the horizontal direction) (the lower end portion of the storage container 21 and the attaching base 12 are used in common) can be attached utilizing an installation space (dead space) of this motor 33M.

Figure 11:
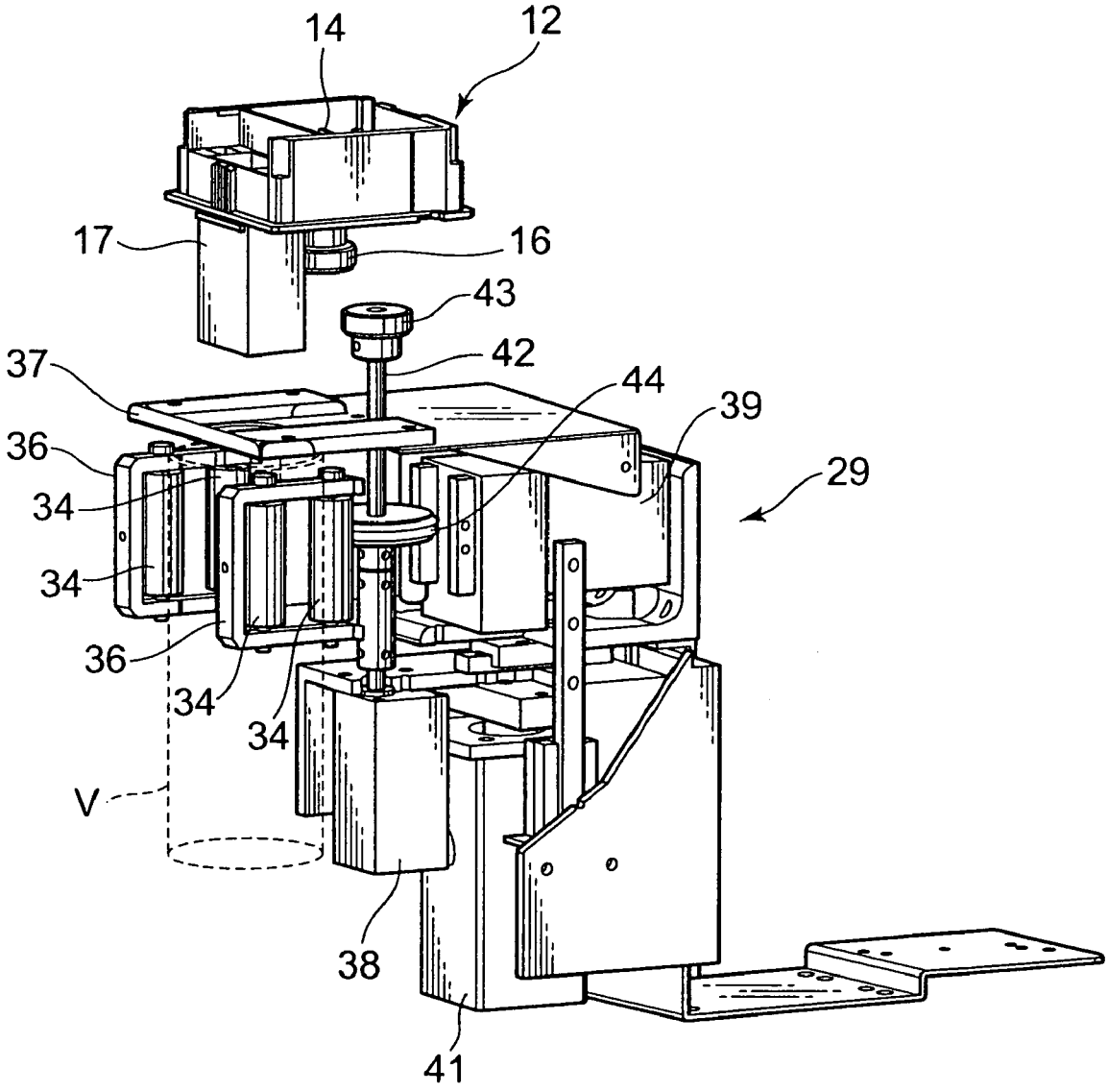
FIG. 11 is a perspective view showing a holding device and an attaching base in the conveying device of the charging device.
Figure 12:
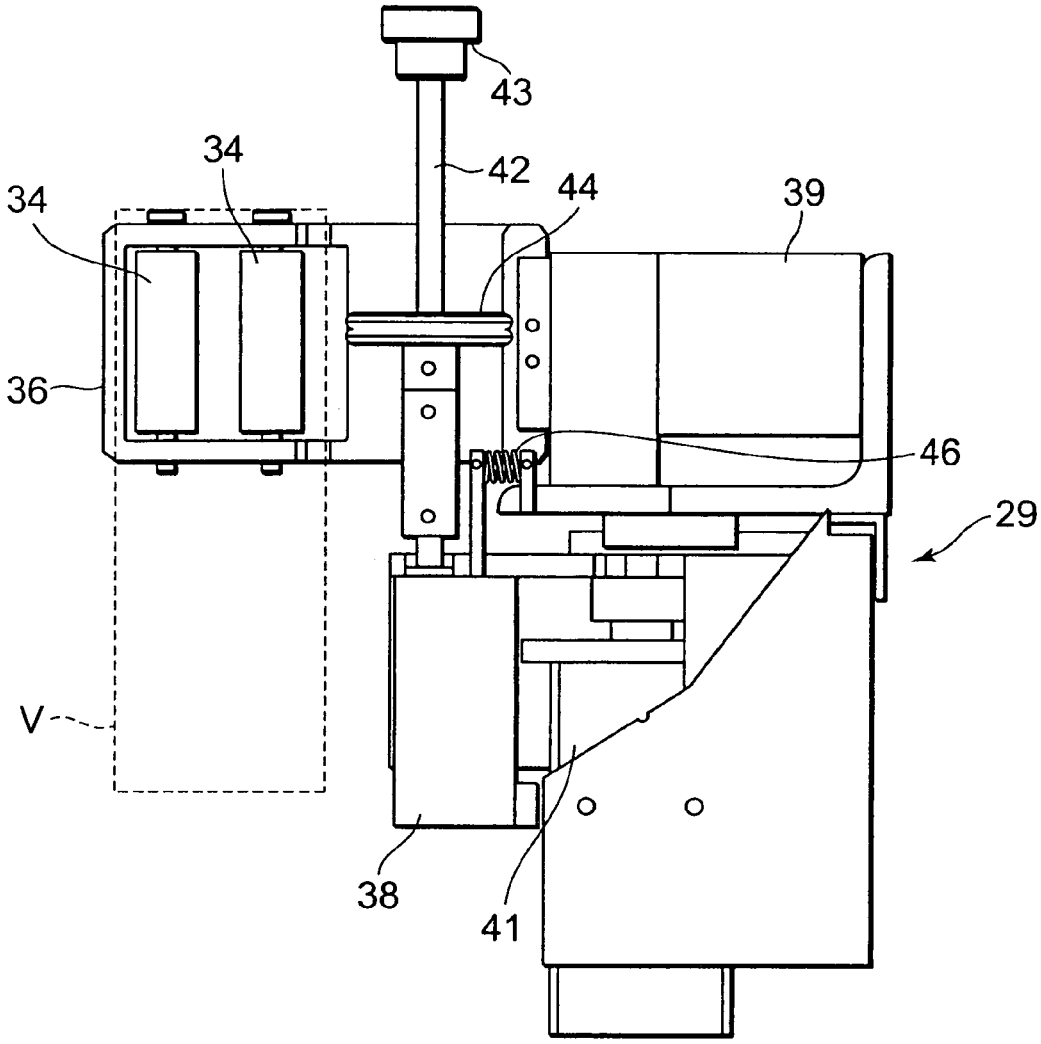
FIG. 12 is a front view of the holding device in the conveying device of the charging device.
Figure 13:
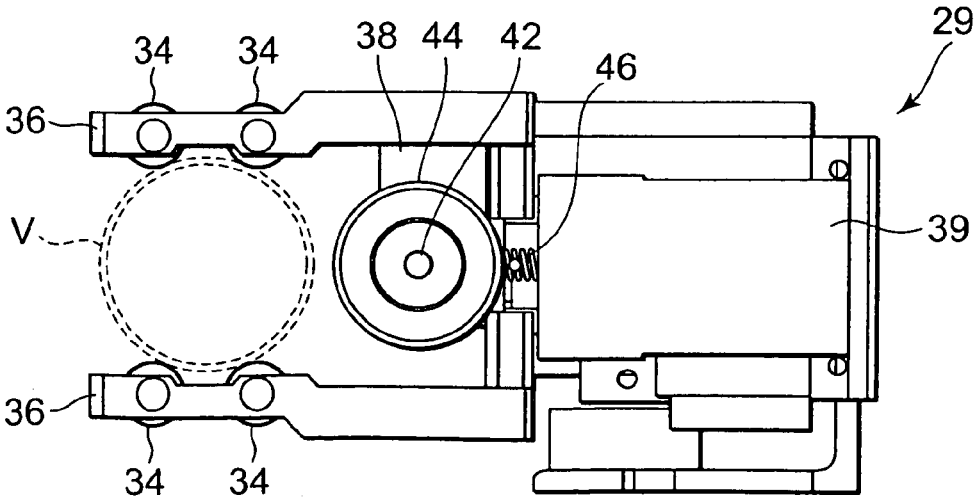
FIG. 13 is a plan view of the holding device of FIG. 12.

Moreover, the holding device 29 is shown in FIGS. 11 to 13. The holding device 29 is integrally constituted of: a pair of holding arms 36, 36 (tips are directed toward the providing unit 3) provided with a pair of holding rollers 34, 34 using a vertical direction as a rotary axis and disposed with a predetermined interval; a medicine detecting sensor (medicine detecting means) 37 (omitted from FIGS. 12 and 13) disposed above the holding arm 36; a rotating motor (driving means) 38 for rotating the discharge drum 13; a holding motor 39 for bringing the holding arms 36, 36 close to each other or detaching the arms from each other to hold or release the medicine bottle V; a raising and lowering motor (raising and lowering means) 41 for raising or lowering the holding arms 36, 36, the medicine detecting sensor 37, the rotating motor 38, and the holding motor 39.

The holding motor 39, for example, rotates forwards to bring the holding arms 36, 36 close to each other, and the medicine bottle V is held between the holding arms 36, 36. Moreover, the motor rotates in reverse to detach the holding arms 36, 36 from each other, thereby releasing the held medicine bottle V. In this case, the medicine bottle V is rotatably held by total of four holding rollers 34 . . . of the holding arms 36, 36 by use of a vertical direction as an axis. The holding arms 36, 36 hold the medicine bottle V in a predetermined holding position so that the upper opening of the medicine bottle V remarkably comes close to the medicine detecting sensor 37 under the sensor. Furthermore, a driving shaft 42 of the rotating motor 38 extends upwards from the vicinity of a base portion of the holding arms 36, 36, a driving gear 43 is attached to a tip of the driving shaft positioned highest in the holding device 29, and a driving roller 44 is attached to a portion of the driving shaft 42 between the base portions of the holding arms 36, 36.

Figure 17:
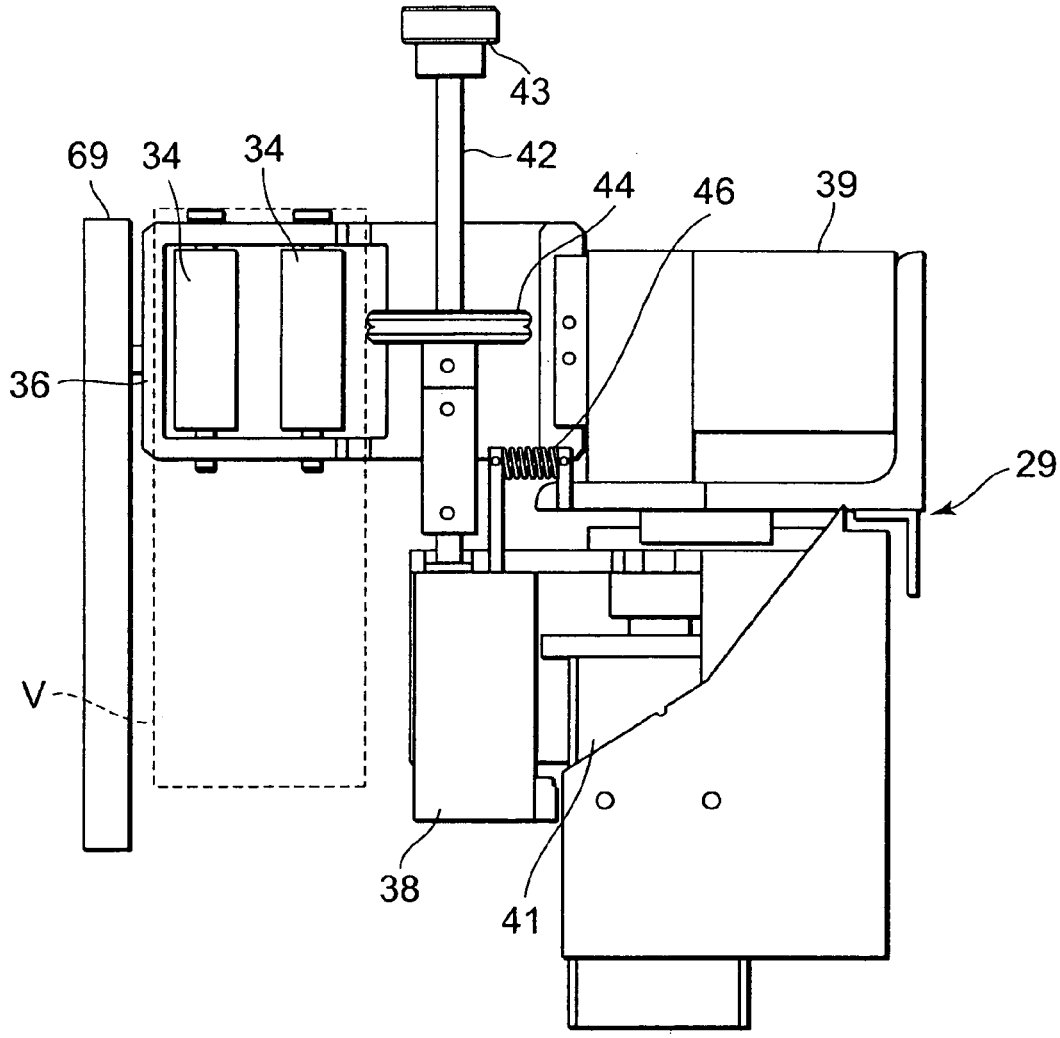
FIG. 17 is a front view of the holding device of the conveying device in the label attaching position.
Figure 18:
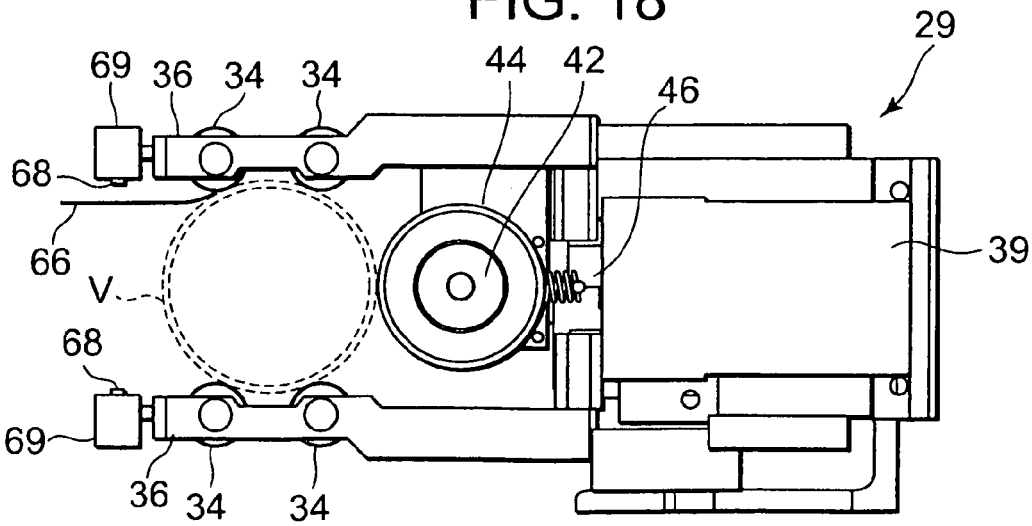
FIG. 18 is a plan view of the holding device of FIG. 17.
Figure 22:
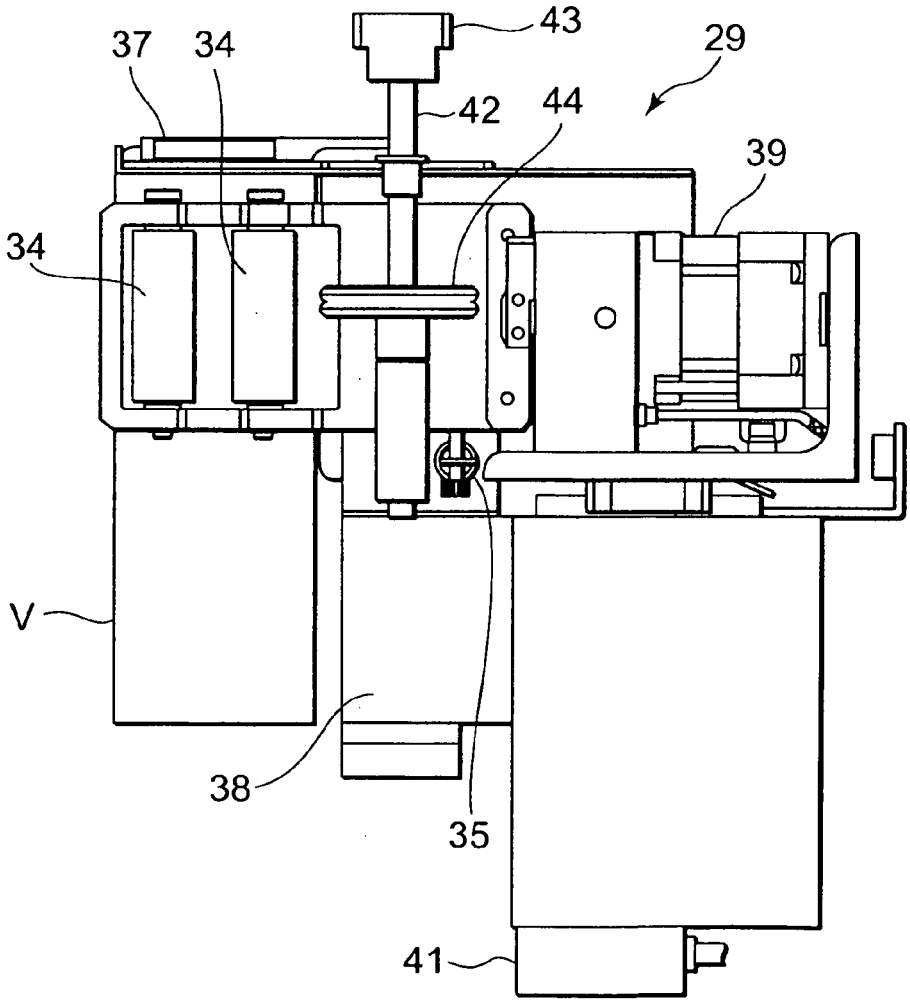
FIG. 22 is a front view showing another embodiment of the holding device of the conveying device in the charging device.
Figure 23:
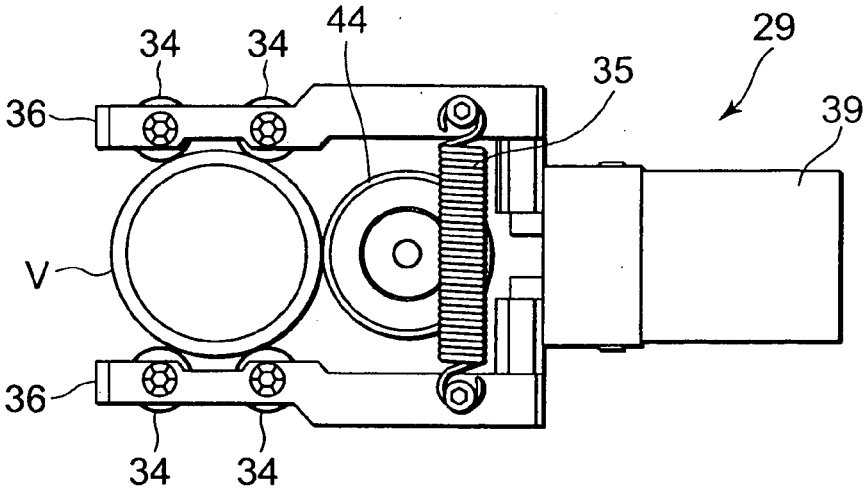
FIG. 23 is a plan view of the holding device of FIG. 22.
Figure 24:
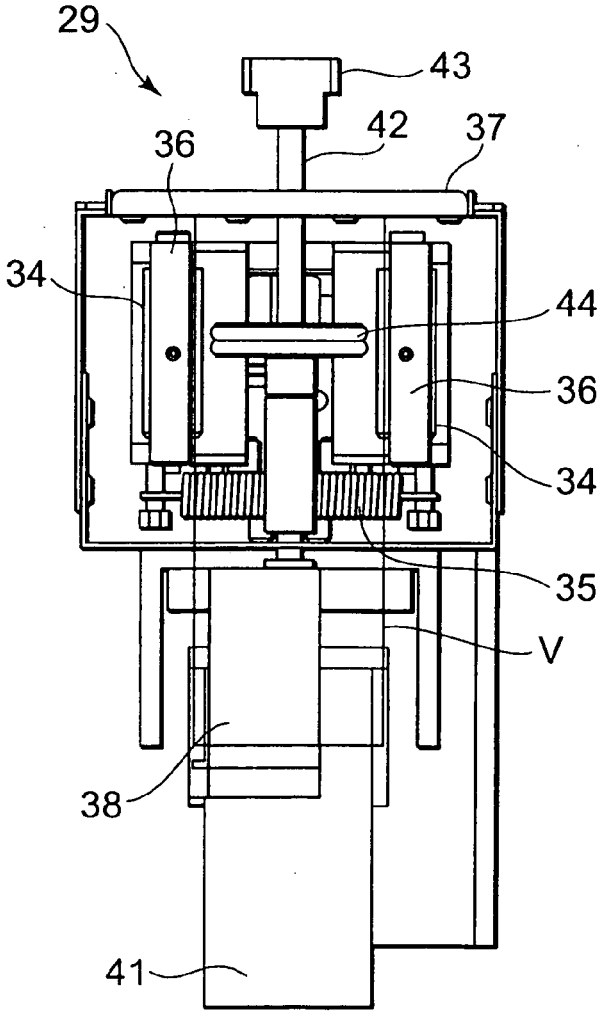
FIG. 24 is a side view of the holding device of FIG. 22.

Here, the holding arms 36, 36 and the holding motor 39 are movable in a direction (horizontal direction in FIG. 12) connecting the tips to the base portions of the holding arms 36, 36, and are constantly urged by a coil spring (urging means) 46 in a direction in which the medicine bottle V held by the holding arms 36, 36 is detached from the driving roller 44. Therefore, the medicine bottle V held by the holding arms 36, 36 does not constantly abut on the driving roller 44 (FIGS. 12, 13). However, when the holding arms 36, 36 and the holding motor 39 are moved toward the base portion of the holding arm 36 against the coil spring 46, the driving roller 44 abuts on the side of the medicine bottle V as shown in FIGS. 17, 18. The medicine bottle V is rotatably held between the holding rollers 34 . . . . Therefore, in a case where the driving roller 44 is rotated while abutting on the side of the medicine bottle V, the bottle also rotates. It is to be noted that in addition to the above-described constitution, when a coil spring (urging means) 35 is disposed so as to constantly bring the holding arms 36, 36 close to each other as shown in FIGS. 22 to 24, the medicine bottle V is mechanically held between the holding arms 36, 36, and prevented from dropping even if power supply is cut off.

Figure 14:
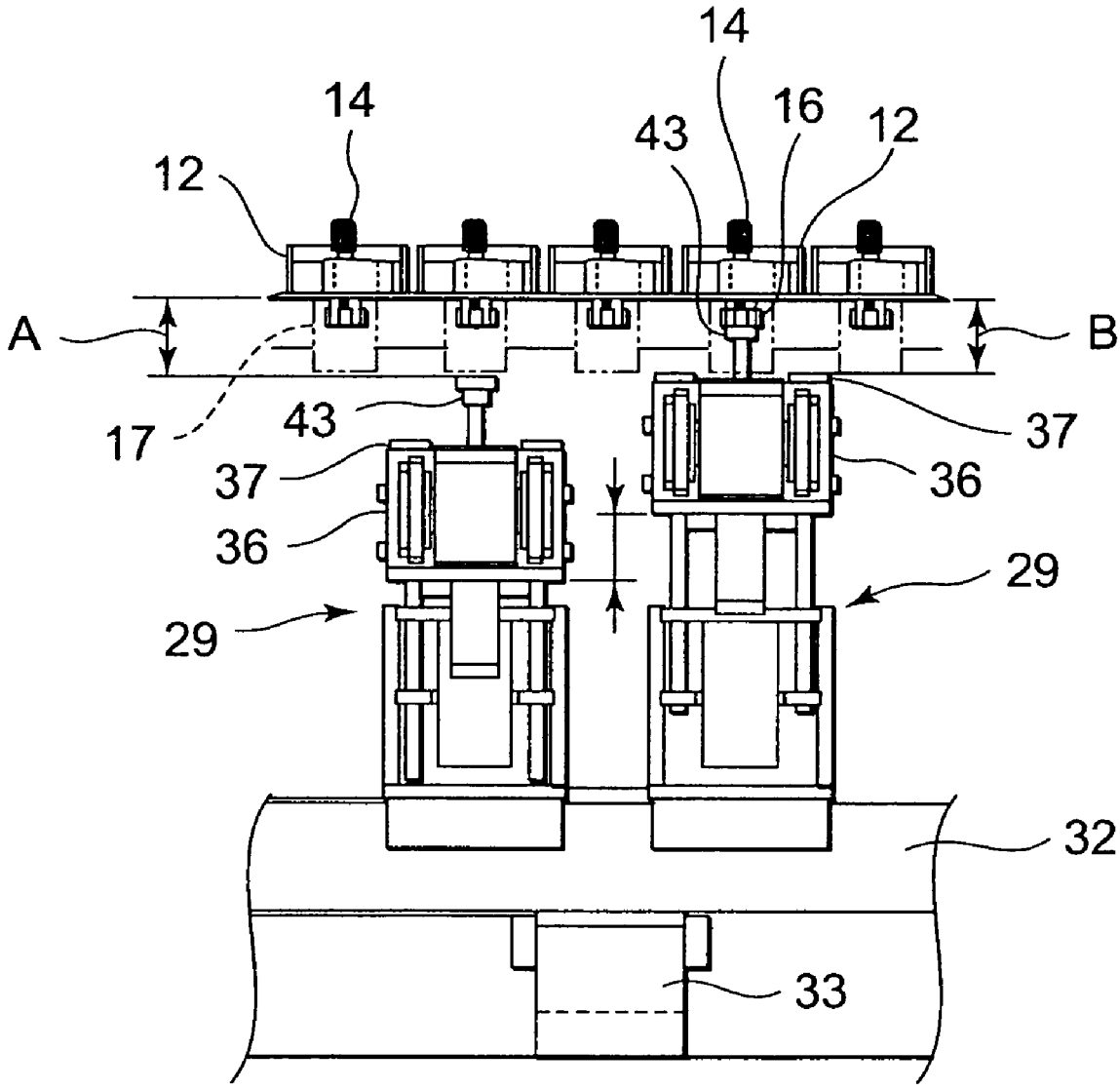
FIG. 14 is an explanatory view of an elevating/lowering operation of the holding device.
Figure 15:
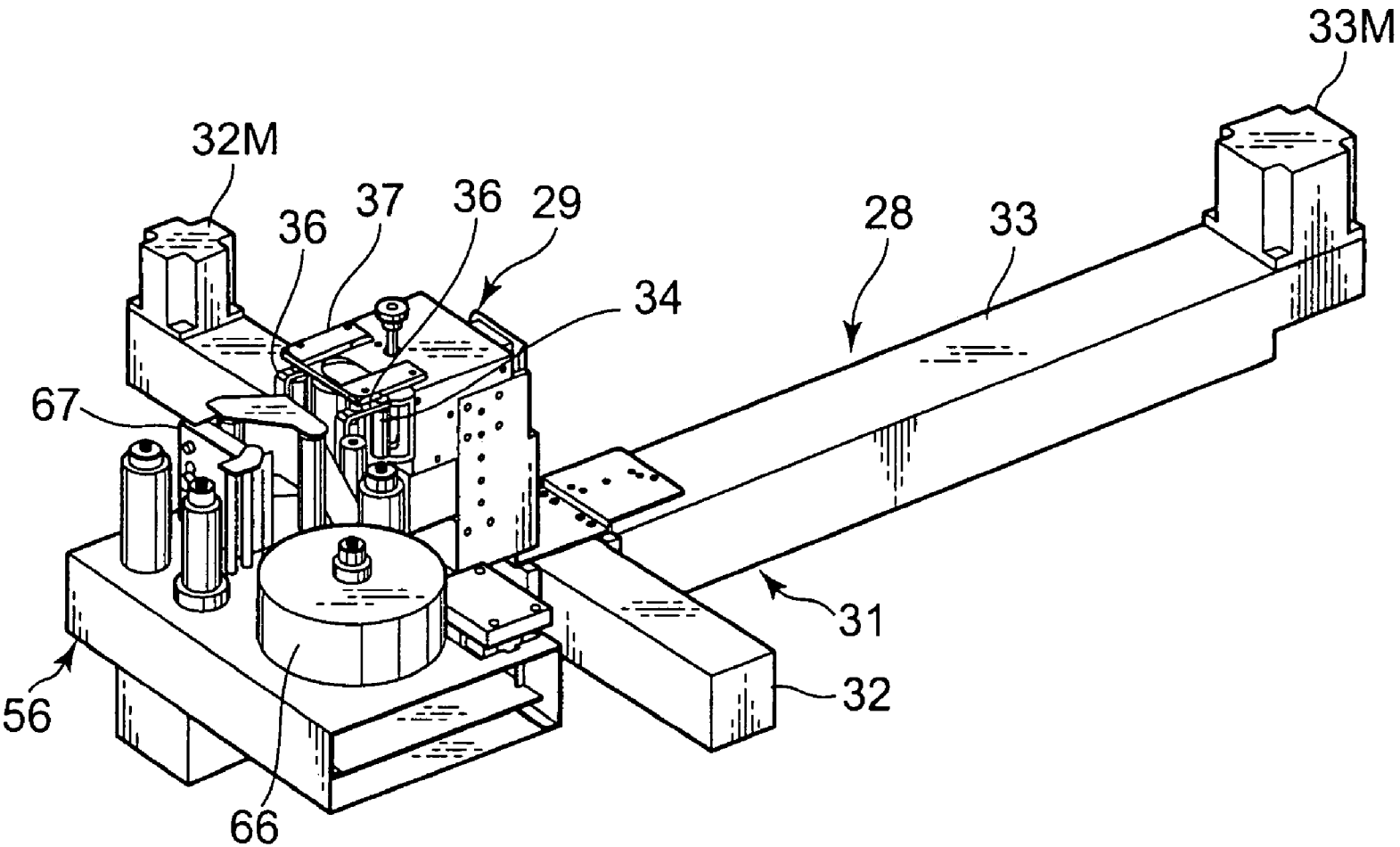
FIG. 15 is a perspective view showing the conveying device and the label attaching device ins the charging device disposed in a label attaching position.
Figure 16:
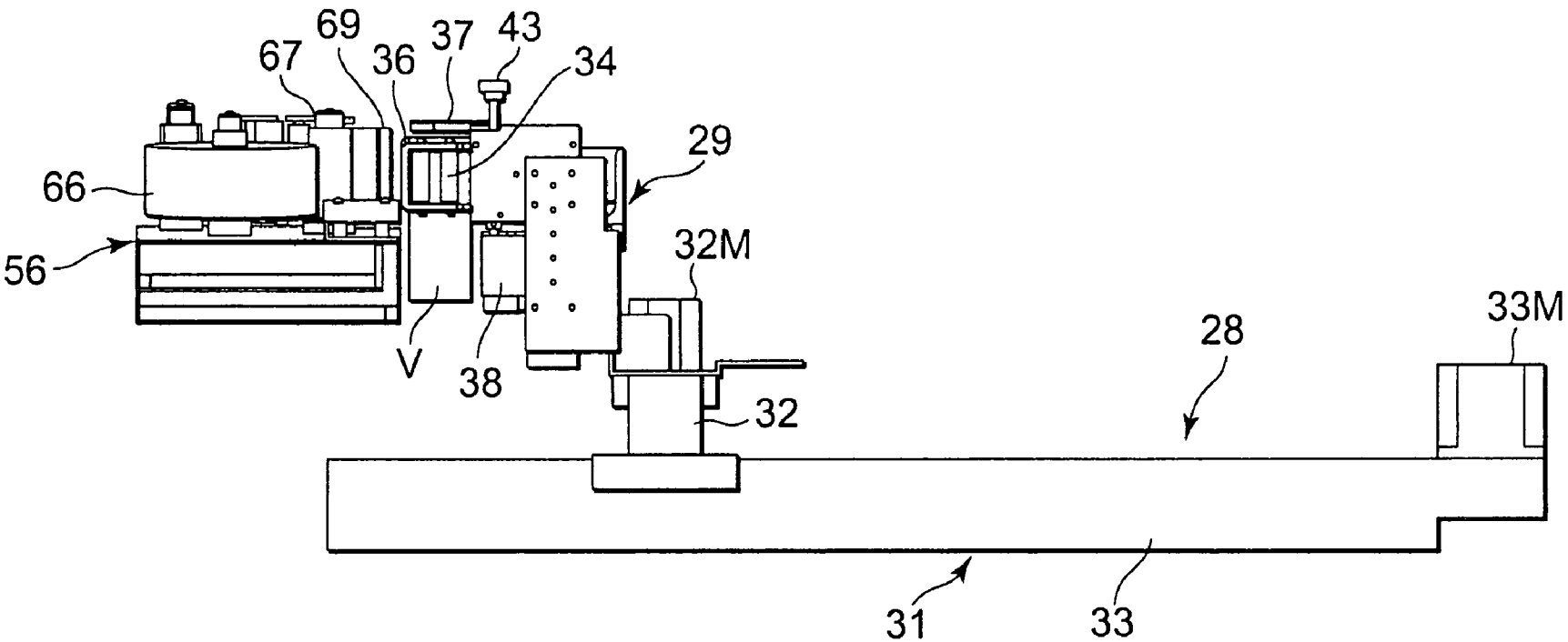
FIG. 16 is a front view of FIG. 15.
Figure 19:
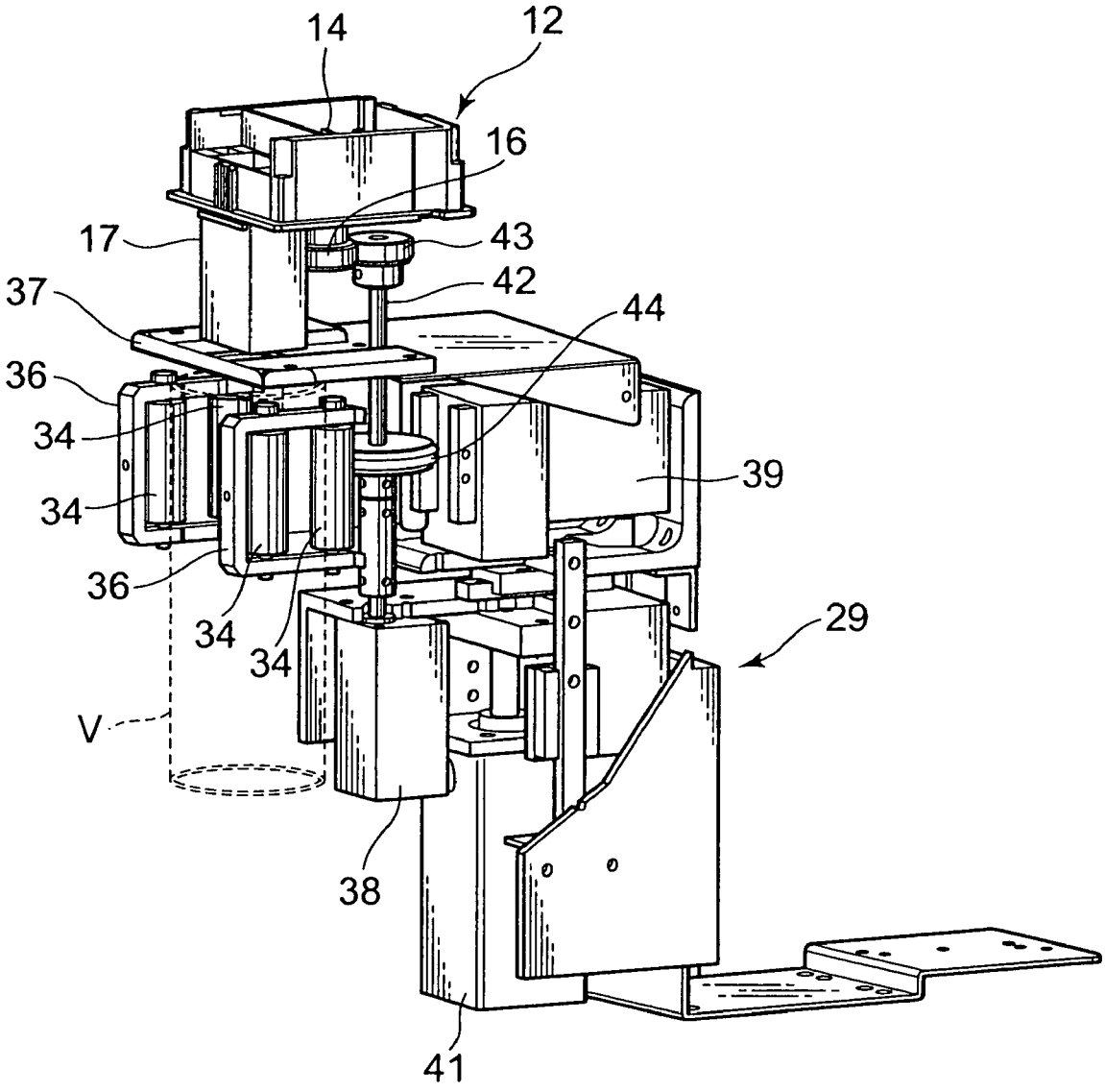
FIG. 19 is a perspective view of the holding device of FIG. 12 in a state in which holding arms rises.

Moreover, the raising and lowering motor 41, for example, rotates forward to raise the holding arms 36, 36, the medicine detecting sensor 37, the rotating motor 38, and the holding motor 39 (on the right side of FIG. 14, FIG. 19). The motor rotates in reverse to lower them (FIG. 11, on the left side of FIG. 14). The driving gear 43 positioned highest in this lowered state is disposed in a position which is lower than a lower end of the chute 17. Accordingly, the holding device 29 is movable in the horizontal direction under the chute 17 of each of the attaching bases 12 . . . without any trouble. When the holding device 29 is moved and disposed under the predetermined tablet case 9, the medicine bottle V faces the lower part of the chute 17. Moreover, when the raising and lowering motor 41 raises the holding arms 36, 36, the medicine detecting sensor 37, the rotating motor 38, and the holding motor 39 in this state, as shown in FIG. 19, the driving gear 43 disengageably engages the engagement gear 16 of the attaching base 12. Accordingly, when the rotating motor 38 is driven, the rotating force is transmitted to the driving gear 43, the engagement gear 16, the engaging shaft 14, and the discharge drum 13 to rotate the discharge drum 13, the medicines are discharged one by one into the chute 17, and drop into the medicine bottle V via the chute as described above.

In this case, assuming that a protruding dimension of the chute 17 is A, and a distance between the raised medicine detecting sensor 37 and the attaching base 12 is B as shown in FIG. 14, B (0.1 mm in the embodiment) is set to be slightly larger than A. In the raised state, the upper opening of the medicine bottle V comes close to the lower opening of the chute 17. Since the dimensions are set as described above, the medicine detecting sensor 37 is positioned externally in a height position between the openings of the bottle and the chute. This medicine detecting sensor 37 detects the medicine in an area including the whole areas of the openings of the chute 17 and the medicine bottle V, but the dimensions are set as described above. Therefore, the medicine detecting sensor 37 can detect the medicine in a position remarkably close to the openings of the medicine bottle V and the chute 17. The medicine detecting sensor 37 is positioned distant from the discharge drum 13 of the tablet case 9 by a dimension corresponding to at least the dimension of the chute 17. Therefore, it is possible to prevent or inhibit a disadvantage that dust, dirt or the like on the medicine bottle sticks to the medicine detecting sensor 37 to deteriorate a detecting precision.

(2) Providing Unit 3

Figure 4:
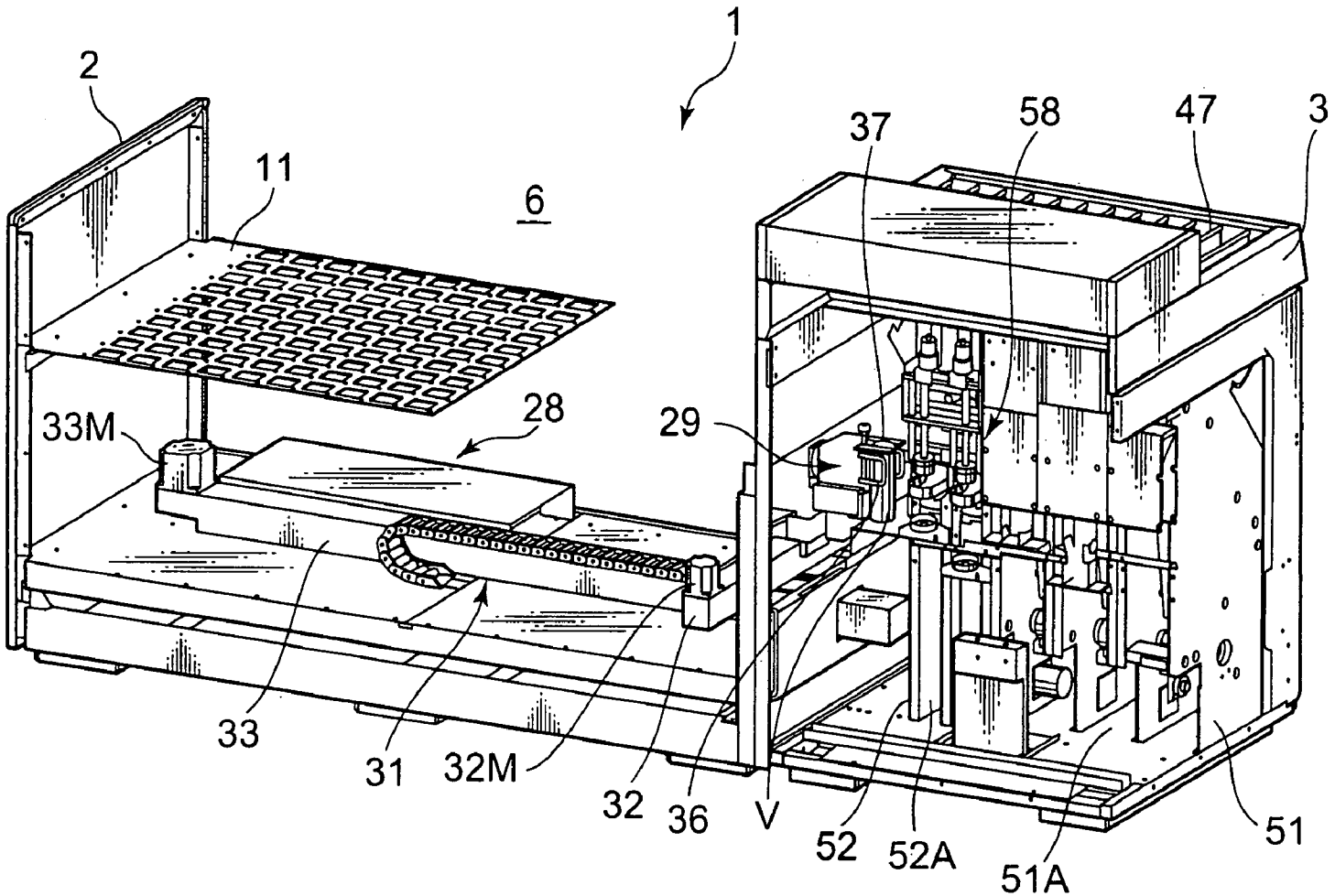
FIG. 4 is similarly a rear perspective view.

Next, a structure of the providing unit 3 will be described. An upper part of the providing unit 3 is provided with aligning conveyers 47 and providing displays 48 which align and provide the medicine bottle V filled with the medicine for each person who is to be provided. Inside the providing unit 3, there are arranged: three medicine bottle units (medicine bottle storage sections) 51 . . . which store a large number of empty medicine bottles V; two lid units 52, 52; a providing device constituted of a conveying device (providing conveyance means) 53 and a holder (providing medicine bottle holding means) 54; a label attaching device (label attaching means) 56; a photographing device (photographing means) 57; a lid closing device 58 (shown in FIGS. 4, 20); two transfer tables 61, 62; a touch panel type display 71 and the like.

Figure 2:
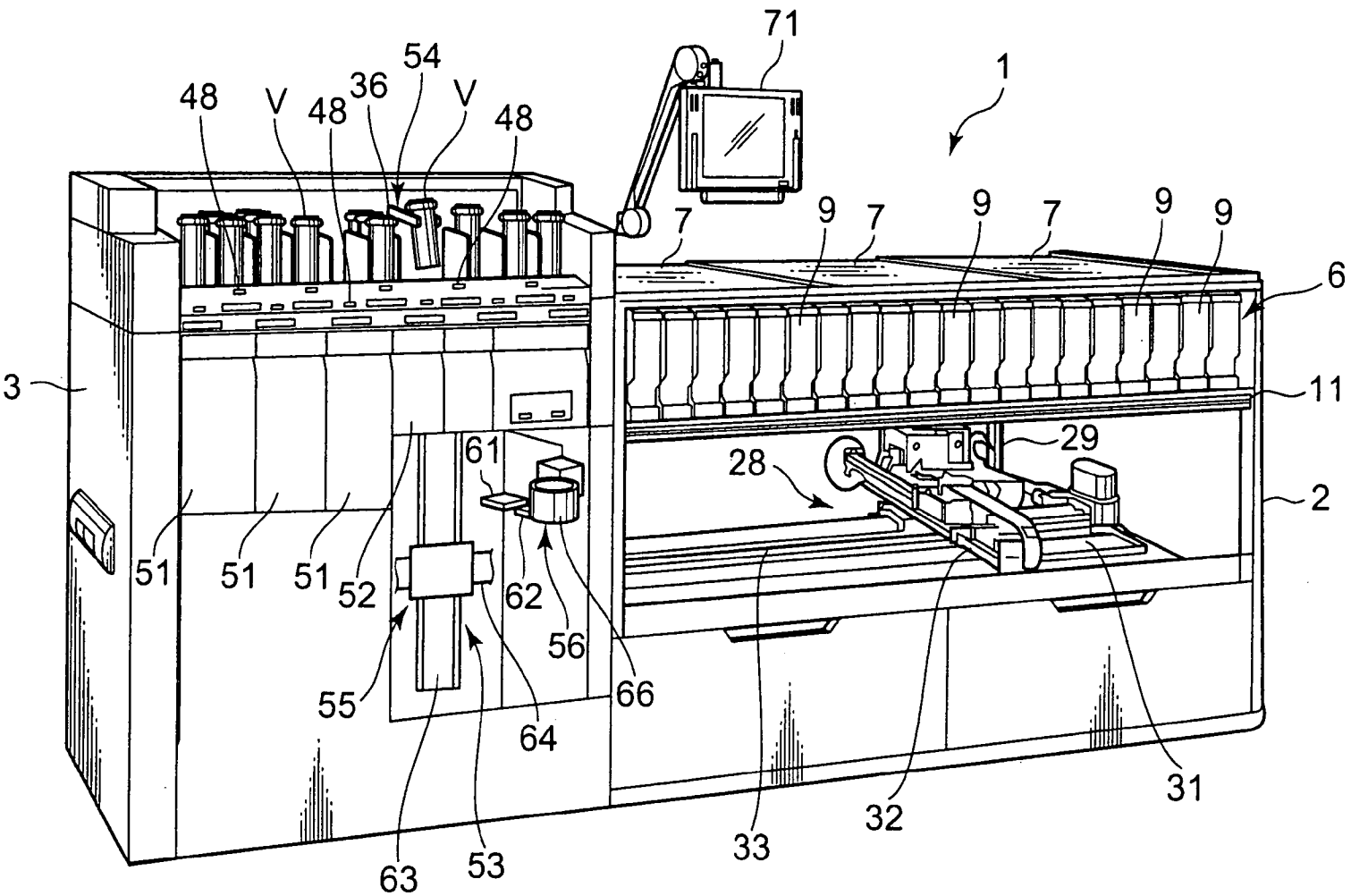
FIG. 2 is a schematic perspective view of a part of an inner constitution of the medicine supply apparatus.
Figure 3:
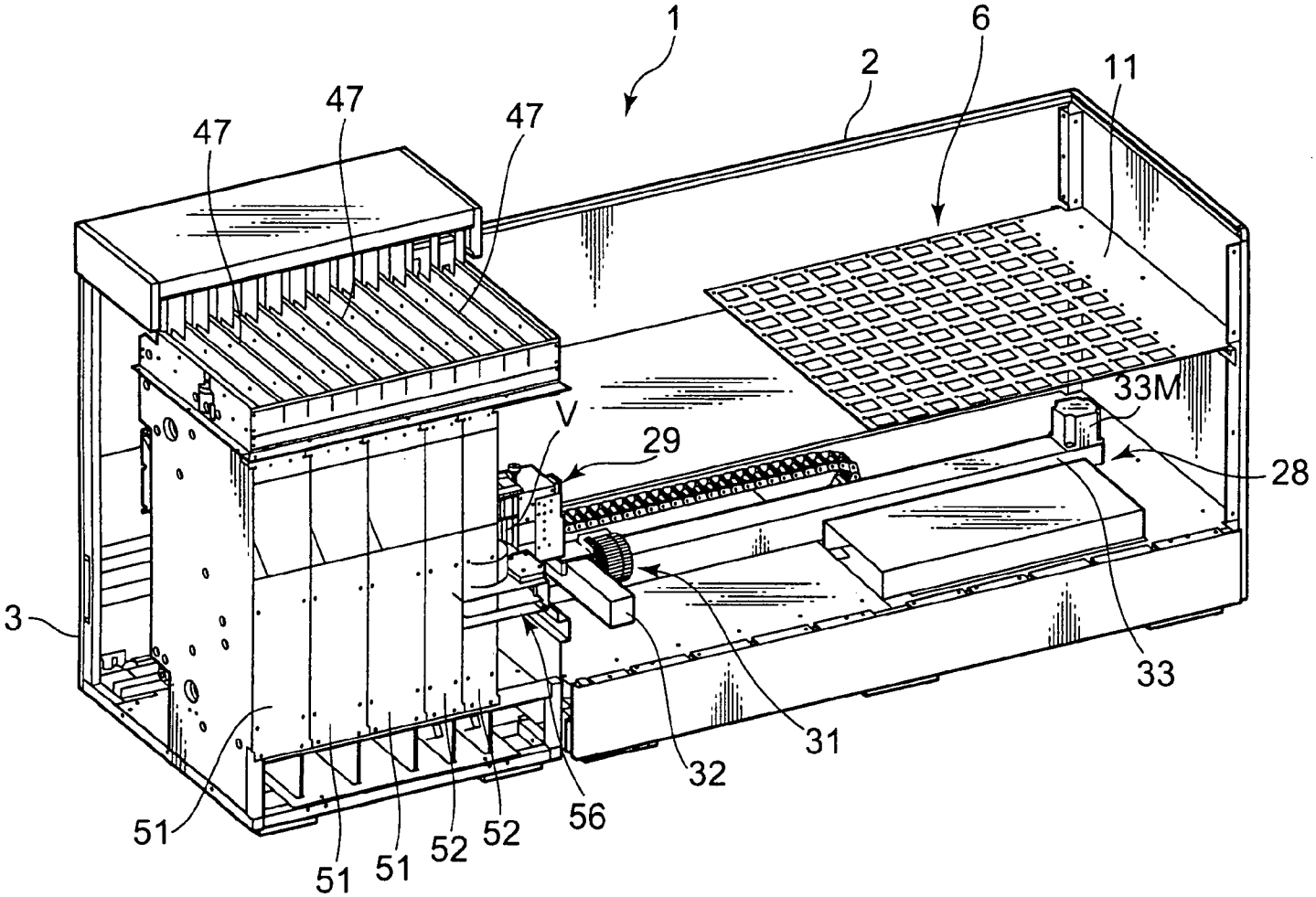
FIG. 3 is a front perspective view of the inner constitution of the medicine supply apparatus.

A plurality of rows of aligning conveyers 47 are partitioned from one another in the top of the providing unit 3, and the filled medicine bottle V is conveyed forwards. The fronts of the respective aligning conveyers 47 . . . are provided with the providing displays 48 corresponding to them, and names of those who are to be provided, such as patients, and the like are displayed in the providing displays 48. A providing device 55 is disposed in a rear part of the providing unit 3. As shown in FIG. 2, the conveying device 53 is constituted of a rail 63 disposed in a vertical direction (perpendicular direction, X-axis) and a rail 64 for moving the rail 63 in a lateral direction (Y-axis), and end portions of the rails 63, 64 are provided with conveying motors (not shown) in the same manner as in the conveying device 31. This motor moves the holder 54 (medicine bottle V) along the X-Y axis in vertical and horizontal directions in the rear part of the providing unit 3. It is to be noted that the holder 54 is provided with the holding arms 36 and motors in the same manner as in the holding device 29, but the holding arms 36 are moved forwards/backwards instead of raising/lowering them. In this case, tips of the holding arms 36, 36 are directed forwards, and are not provided with constitutions corresponding to the rotating motors.

Moreover, the medicine bottle units 51 . . . and the lid units 52, 52 are attached to the front of the providing unit 3, and detachably disposed in three medicine bottle storage sections and two lid storage sections of the providing unit 3, respectively. In this case, inner constitutions of the medicine bottle units 51 . . . differ with dimensions of the medicine bottles V to be stored, but outer shapes and basic constitutions of the units are the same. Even the medicine bottle unit 51 containing the medicine bottle V having any dimension can be attached to any of the three medicine bottle storage sections. Accordingly, the medicine bottle unit 51 for use can be arbitrarily selected and attached depending on the dimension of the medicine bottle V for use. That is, in a case where many medicine bottles V having large dimensions are used, it is assumed that all or two medicine bottle units 51 store the medicine bottles V having large dimensions and that the remaining medicine bottle unit 51 stores the medicine bottles V having small dimensions. Conversely, in a case where many medicine bottles V having small dimensions are used, it may be assumed that all or two medicine bottle units 51 store the medicine bottles V having small dimensions and that the remaining medicine bottle unit 51 stores the medicine bottles V having large dimensions.

Here, it is assumed that the medicine bottle V is a substantially cylindrical container made of a hard synthetic resin and having an open top and that the bottles have two types of large and small dimensions as described above depending on sizes or quantities of the medicines to be charged. Since the medicine bottle V is made of such hard resin, a peripheral side of the bottle is slightly tapered to open wide toward the upper opening. In the lid unit 52, there are stored a large number of lids for sealing the upper openings of the medicine bottles V.

Moreover, the label attaching device 56 is disposed on the side of the charging unit 2 in a front part of the providing unit 3, and constituted of: a rolled wound label 66 whose back is coated with an adhesive; a printer 67 for printing the surface of this label 66; a sensor 68 for detecting that the printed label 66 is delivered to a predetermined position and the like. After the label 66 is printed with the printer 67, it is fed between a pair of supports 69, 69 (FIGS. 17, 18). The sensors 68 are attached to inner faces of the supports 69, 69. An interval between the supports 69 and 69 is equal to that between the holding arms 36 and 36 of the holding device 29.

Furthermore, the photographing device 57 photographs the medicine bottle V from above before the bottle is filled with the medicine and closed with the lid, and records an image of the medicine in the bottle. The lid closing device 58 takes the lid from the lid unit 52, and attaches the lid to the upper opening of the medicine bottle V photographed by the photographing device 57 to seal the bottle. The transfer tables 61, 62 are disposed in two front and rear portions of the providing unit 3 behind the label attaching device 56 on the side of the charging unit 2, and can be raised and lowered by raising and lowering motors 61M, 62M so as to adjust heights of the tables.

(3) Control Device 72

Figure 20:
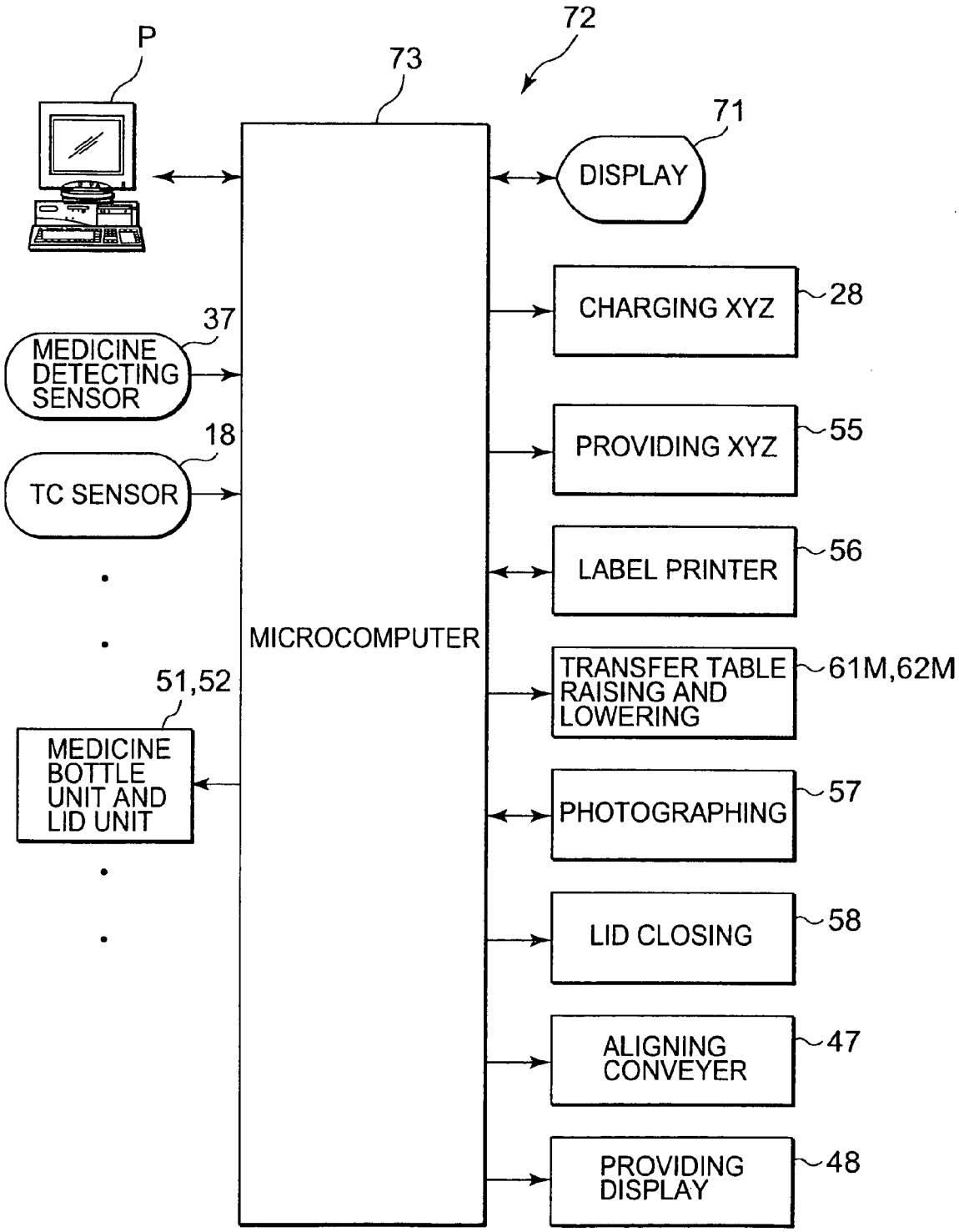
FIG. 20 is a circuit block diagram of a control device of the medicine supply apparatus.

Next, FIG. 20 shows a circuit block diagram of a control device 72 of the medicine supply device 1. The control device 72 is constituted of a microcomputer 73, and this microcomputer 73 is connected to the tablet case sensors 18 . . . and the medicine detecting sensor 37. The microcomputer 73 is also connected to the display 71, the charging device 28, the providing device 55, the label attaching device 56, the transfer table raising and lowering motors 61M, 62M, the photographing device 57, the lid closing device 58, the aligning conveyers 47 . . . , the providing displays 48 . . . , the medicine bottle unit 51, and the lid unit 52 to control them. The microcomputer 73 is also connected to an external personal computer P so as to communicate data.

(4) Operation of Medicine Supply Device 1

Next, there will be described an operation of the medicine supply device 1 constituted as described above. It is to be noted that it is assumed that in the microcomputer 73, there are input beforehand data on an address (position) of the tablet case 9 and the kind of medicine contained in the tablet case. In this case, in a case where any tablet case 9 is not attached to the attaching base 12, the microcomputer 73 grasps the address where any tablet case 9 is not attached based on an output of the tablet case sensor 18. Thereafter, any medicine bottle V is not moved to the corresponding address (position). In consequence, a useless control operation can be omitted, and a charging time can be reduced.

(4-1) Transfer of Empty Medicine Bottle V

Now, when predetermined prescription data is input into the microcomputer 73 via input from a touch panel of the display 71 or data communication from the personal computer P, the microcomputer 73 selects the medicine bottle V capable of containing the quantity of medicine designated by the prescription data, and drives each motor of the conveying device 53 of the providing device 55 to move the holder 54 to a takeout port 51A of the medicine bottle unit 51 in which the empty medicine bottles V are stored. Moreover, the microcomputer drives the holding motors of the holding arms 36, 36 to hold the empty medicine bottle V, and controls again the conveying device 53 to move the holder 54 to the transfer table 61. Moreover, the microcomputer releases the empty medicine bottle V from the holding arms 36, 36 to lay the bottle on a predetermined position of the transfer table 61.

(4-2) Charging of Medicine

Figure 21:
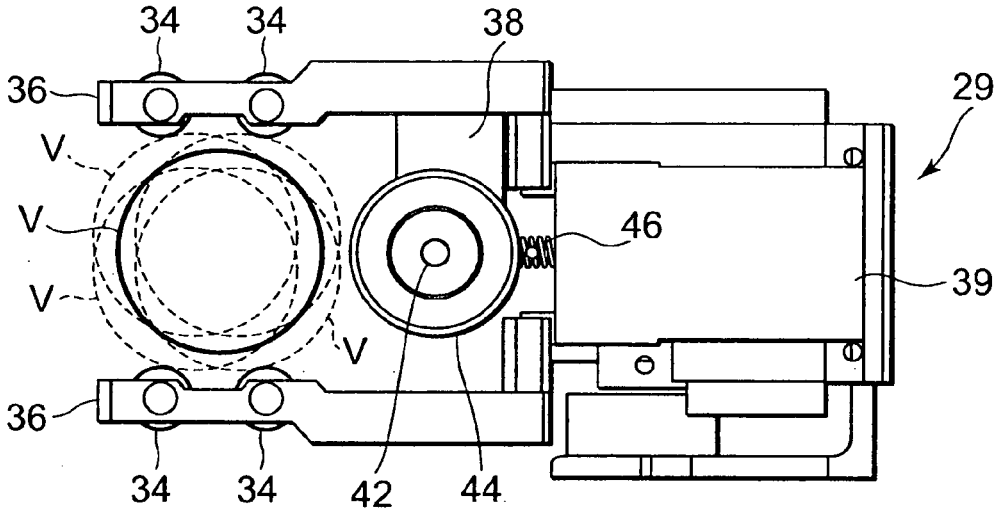
FIG. 21 is another plan view of the holding device of FIG. 12.

Next, the microcomputer 73 drives the respective motors 32M, 33M of the conveying device 31 of the charging device 28 to move the holding device 29 to the transfer table 61. Moreover, the microcomputer controls the holding motor 39 to hold the empty medicine bottle V on the transfer table 61 to hold the bottle between the rollers 34 . . . of the holding arms 36 and 36. In this case, the microcomputer 73 drives the raising and lowering motor 61M depending on the size of the selected empty medicine bottle V to adjust the height of the transfer table 61 so that the empty medicine bottle V can be held by the holding arms 36, 36 of the holding device 29 in the above-described holding position. That is, when the empty medicine bottle V has a large height and a large capacity, the transfer table 61 is lowered. When the empty medicine bottle V has a small height and a usual capacity, the transfer table is raised. Accordingly, the holding arm 36 of the holding device 29 can hold the empty medicine bottle V therebetween constantly in the holding position. It is to be noted that the microcomputer 73 also subjects the transfer table 62 to similar height adjustment by the raising and lowering motor 62M. In a case where the position of the empty medicine bottle V laid on the transfer table 61 deviates from a predetermined position, when the holding device 29 is moved to the transfer table 61, the position of the medicine bottle V falls in a position deviating from the predetermined position between the respective holding arms 36 and 36 as shown by a broken line in FIG. 21. However, when the holding arms 36, 36 are brought close to the medicine bottle V, the bottle surely first abuts on the holding roller 34 in the closest position, and is rotated and moved. The bottle successively abuts on the other holding roller 34, and is finally forcibly positioned in the predetermined position in the center of all of the holding rollers 34, 34, 34, and 34. Even in a case where the position (position in the horizontal direction) of the medicine bottle V on the transfer table 61 deviates, the holding rollers 34 . . . cooperate with one another to guide the medicine bottle V to the predetermined position. Therefore, a positioning precision is improved. This also applies to the holder 54.

When the holding device 29 holds the empty medicine bottle V, the microcomputer 73 drives the respective motors 32M, 33M of the conveying device 31 to move and dispose the holding device 29 and the empty medicine bottle V under the address of the tablet case 9 in which the medicine designated by the prescription is stored. Next, the lifting/lowering motor 41 is driven to raise the holding arms 36, 36, the medicine detecting sensor 37, the rotating motor 38, and the holding motor 39 to engage the driving gear 43 with the engagement gear 16 of the attaching base 12 as shown on the right side of FIG. 14 and FIG. 19.

(4-2-1) Control of Discharge Speed

Next, the microcomputer 73 drives the rotating motor 38 to rotate the discharge drum 13 via the driving gear 43, the engagement gear 16, and the engaging shaft 14. Accordingly, the medicines in the vertical groove 24 of the discharge drum 13 naturally drop one by one into the medicine bottle V via the chute 17 as described above. The medicine detecting sensor 37 detects that the medicine drops downwards from the lower end opening of the chute 17. The microcomputer 73 counts the number of the medicines which have dropped into the medicine bottle V based on the detecting operation of the medicine detecting sensor 37, and stops the rotating motor 38, when the quantity reaches that designated by the prescription, thereby ending the discharging and charging operation.

In this case, the microcomputer 73 adjusts the number of revolutions of the rotating motor 38 depending on the kind of medicine stored in the tablet case 9, and changes the discharge speed of the medicine. That is, when the medicine has a small size, a time for which the medicine passes the medicine detecting sensor 37 shortens. When the medicine has a round shape, the passage time similarly shortens (because the passage time of the medicine having a long shape lengthens). In this case, even when the number of revolutions of the rotating motor 38 is increased to increase the discharge speed of the medicine from the discharge drum 13, the medicine detecting sensor 37 can detect the medicine without any trouble. Therefore, the microcomputer 73 sets the number of revolutions (large number of revolutions, e.g., 70 RPM or the like) of the rotating motor 38 to be larger than the usual number of revolutions (e.g., 40 RPM or the like) described later to increase the discharge speed and shorten the charging time based on the preset kind of medicine with respect to the tablet case 9 of the address in a case where the size of the medicine is smaller than a predetermined reference value (assuming that the reference value is predetermined so as to judge the size of the medicine) and/or a case where the medicine has a round shape (including a shape approximate to the round shape). It is to be noted that in a case where the medicine has a large size, the rotating motor 38 is set to the usual number of revolutions. In the present embodiment, the number of revolutions of this rotating motor 38 is changed to two stages (the usual number of revolutions and the large number of revolutions). In addition, the number of revolutions may be finely controlled into stages such as three stages, or may be continuously changed (in a range of, e.g., 30 to 70 RPM) depending on the kind of medicine (size, shape).

Moreover, the microcomputer 73 decreases the number (e.g., 10 RPM) of revolutions of the rotating motor 38 to slow down the discharge speed of the medicine just before completing the counting of the medicines based on the detecting operation of the medicine detecting sensor 37, that is, when the counted quantity reaches five medicines (predetermined remaining quantity) before the designated quantity). This improves a detecting precision by the medicine detecting sensor 37. That is, this control improves a medicine counting precision while reducing the medicine charging time as described above. Especially, when the number of revolutions of the rotating motor 38 is set to be small, the discharge drum 13 is precisely stopped in a normal position. This prevents excessive discharge, and also improves a discharge precision.

It is to be noted that the driving roller 44 also rotates during such medicine discharge operation, but as shown in FIGS. 12, 13, the driving roller 44 does not abut on the medicine bottle V held by the holding arms 36, 36. Here, as described above, the peripheral side of the medicine bottle V is tapered so as to expand toward the upper opening. Therefore, when the driving roller 44 abuts on the medicine bottle V during such discharge operation, the medicine bottle V is also rotated by driving the rotating motor 38. On the other hand, since the rotations are performed several tens of times or more during the discharge operation, there is a danger that the medicine bottle V having the tapered peripheral side moves and deviates upwards. However, as shown in FIGS. 12, 13, the driving roller 44 is prevented from being brought into contact with the medicine bottle V during the medicine discharge operation to prevent such disadvantage. Here, each of the holding rollers 34 . . . is tapered in accordance with the taper of the medicine bottle V, but in actual, a taper value differs with the size of the medicine. Therefore, it is impossible to impart a completely matched taper to the holding roller 34. Therefore, the above-described constitution further exerts its effect. On the other hand, when the holding roller 34 is vertically halved (to obtain eight rollers in total in the embodiment), the taper of the roller can be completely matched with that of the medicine bottle V. In consequence, a holding force can be increased to realize stable conveyance. However, the taper of the holding roller 34 can be removed unless the increase of the holding force is demanded. A material of the holding roller 34 is preferably rubber-based because the holding force of the medicine bottle V by the material is larger than that by a metal-based material.

(4-2-2) Medicine Overflow Preventive Control

Here, there occurs a problem that the medicines discharged from the tablet case 9 overflow the medicine bottle V, for example, in a case where there is a mistake in the preset size of the medicine, and the size of the selected medicine bottle V is smaller than the total quantity of the medicines to be charged or a case where the rotating motor 38 and the control system break.

In such a case, the medicines are piled up to protrude upwards from the upper opening just before they overflow the medicine bottle V. On the other hand, the upper opening of the medicine bottle V held in the predetermined holding position is remarkably close to the medicine detecting sensor 37 under the sensor. When the medicines drop, the medicine detecting sensor 37 detects the passing medicine. Therefore, the output of the sensor forms a pulse. However, when the medicines are piled up to protrude upwards from the upper opening of the medicine bottle V, the medicine detecting sensor 37 continuously detects this pile of raised medicines, and the output becomes continuous without emitting any pulse.

When the medicine detecting sensor 37 continuously detects the medicines in this manner, the microcomputer 73 judges that the medicines are going to overflow the medicine bottle V, and stops the rotating motor 38 to stop the rotation of the discharge drum 13. In this case, a switch may be separately disposed in a power supply path to the rotating motor 38 for a case where the rotating motor 38 becomes uncontrollable. Accordingly, the discharging of the medicines is stopped before the medicines overflow the medicine bottle V, and it is possible to avoid in advance the disadvantage that the medicines overflow the medicine bottle V. Moreover, a predetermined overflow alarm is displayed in the display 71 (constituting alarming means) to thereby warn an operator (pharmacist or the like) that the medicines are to overflow the medicine bottle V. Consequently, a user can quickly handle the problem.

(4-3) Label Attaching

Figure 5:
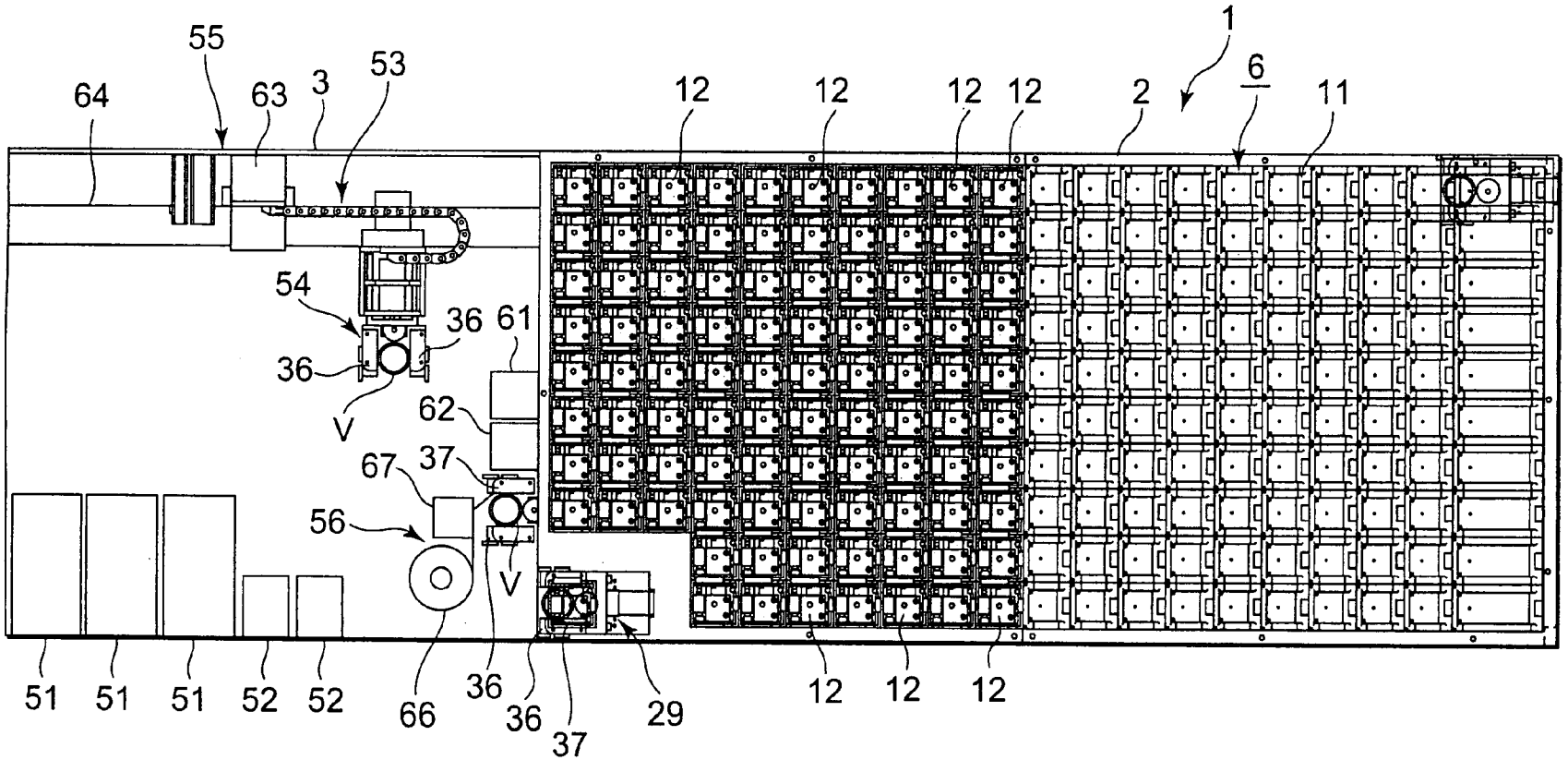
FIG. 5 is similarly a plan view.

After the medicine bottle V is filled with the quantity of the medicines designated by the prescription in this manner, the microcomputer 73 drives the raising and lowering motor 41 to lower the holding arms 36, 36, the medicine detecting sensor 37, the rotating motor 38, and the holding motor 39 (FIG. 11, the left side of FIG. 14). Next, the microcomputer 73 drives the respective motors 32M, 33M of the conveying device 31 of the charging device 28 to move the holding device 29 to the label attaching device 56 (FIG. 5). In this position (label attaching position), the holding arms 36, 36 of the holding device 29 are disposed in positions corresponding to those of the supports 69, 69 of the label attaching device 56.

During the charging of the medicines or after moving the holding device 29 to the label attaching device 56, the microcomputer 73 allows the printer 67 to print, on the surface of the label 66, information on dosing, such as the name of the patient who is a person to be provided with the medicine bottle V, the name of the medicine, and dosage and administration. Next, the label 66 is fed between the supports 69 and 69. When the sensor 68 detects the tip of the label, the microcomputer drives the motor 33M of the conveying device 31 to press the holding arms 36, 36 of the holding device 29 onto the supports 69, 69. According to this pressing operation, the holding arms 36, 36 and the holding motor 39 are moved toward the base portions of the holding arms 36, 36 against the coil spring 46. Therefore, as shown in FIGS. 17 and 18, the driving roller 44 abuts on the side (outer surface) of the medicine bottle V. Here, a gap between the medicine bottle V and the driving roller 44 is, for example, about 4 mm in a case where the medicine bottle V has a large size, and, for example, about 2 mm in a case where the medicine bottle V is large in a state in which the medicine bottle V is held between the holding arms 36 and 36 as shown in FIG. 13. The microcomputer 73 drives the motor 33M to move the holding device 29 toward the support 69. When the holding arms 36, 36 abut on the support 69, the holding device 29 is moved further 2 mm for the large medicine bottle V, and further 4 mm for the small medicine bottle V toward the support 69, and the holding motor 39 is moved toward the base portion of the holding arm 36. Accordingly, the driving roller 44 abuts on the side of the medicine bottle V. It is to be noted that when the size of the medicine bottle V is set to be smaller (thinner) or larger (thicker), the microcomputer 73 changes a movement amount of the holding device 29 after the holding arm 36 abuts on the support 69 in accordance with a preset gap dimension between the medicine bottle V and the driving roller 44.

In this case, the tip of the printed label 66 comes into contact with the side (outer surface) of the medicine bottle V (FIG. 18). The microcomputer 73 drives the rotating motor 38 at a time when the sensor 68 is interrupted by the tip of the label 66, and stops the rotating motor 38, for example, one second (predetermined time) after the label 66 passes the sensor 68. Since the driving roller 44 abuts on the side of the medicine bottle V as described above, the medicine bottle V rotates with the rotation of the driving roller 44. Since the label 66 is cut by a predetermined portion, or precut, the printed label 66 is drawn and attached while sticking to the side (outer surface) of the medicine bottle V under the control of the rotating motor 38. Such constitution can totally automate the filling of the medicine bottle V with the medicine to the attaching of the label. The label 66 can be attached to the outer surface of the medicine bottle V by use of the rotating motor 38 for rotating the discharge drum 13 to discharge the medicine from the tablet case 9. In consequence, the number of components and costs can be remarkably reduced.

(4-4) Transfer of Filled Medicine Bottle V

After attaching the label 66 to the side of the medicine bottle V in this manner, the microcomputer 73 drives the motor 33M of the conveying device 31 to detach the holding arms 36, 36 of the holding device 29 from the supports 69, 69. Next, the motors 32M, 33M of the conveying device 31 are controlled to move the holding device 29 to the transfer table 62. Moreover, the filled medicine bottle V is released from the holding arms 36, 36, and laid on the transfer table 62. In this state, the microcomputer 73 allows the photographing device 57 to photograph the medicine bottle V from above, and takes in an image of the medicine in the medicine bottle V to store the image in a storage device. Since the stored image can be displayed in the display 71, the medicine charged in the medicine bottle V can be easily confirmed. Consequently, erroneous providing of the medicine can be avoided in advance, or the image becomes useful in investigating a cause for the erroneous providing.

(4-5) Providing of Medicine

Next, the microcomputer 73 controls the conveying device 53 of the providing device 55 to move the holder 54 to the transfer table 62. Moreover, the motor is controlled to hold the filled medicine bottle V with the holding arms 36, 36 on the transfer table 62. Furthermore, the conveying device 53 is controlled to move the holder 54 and the medicine bottle V to the lid closing device 58 disposed as high as the transfer table 62 in the vicinity of the transfer table, and the upper opening of the medicine bottle V is covered with the lid discharged from the lid unit 52 to seal the opening. Next, the microcomputer 73 controls the conveying device 53 to raise the medicine bottle V closed with the lid. Moreover, the bottle is moved horizontally, and laid on the predetermined aligning conveyers 47 on the top of the providing unit 3. Even when the medicine bottle V is raised and moved horizontally, the bottle is closed with the lid, thereby prevented the contained medicine from being spilled. Moreover, the aligning conveyer 47 conveys the laid medicine bottle V forwards to align it in a predetermined providing position.

The microcomputer 73 turns off the providing display 48 disposed after the aligning conveyer in a case where there is not any medicine bottle V on the aligning conveyer, blinks the providing display 48 during the aligning and providing of the medicine bottle V, and continuously turns on the providing display 48 in a case where the alignment is completed. The microcomputer 73 displays, in the providing display 48, the name of the patient who is the person to be provided with the medicine bottle V, or specifying information from a time when the bottles are aligned. The microcomputer turns off the display in a case where the medicine bottle V is taken out. Consequently, the medicine bottles V are classified for each person to be provided, aligned, and provided. Therefore, the operator can easily and securely find the medicine bottle V to be provided to the patient. In consequence, smooth medicine providing is realized, and erroneous medicine providing can be avoided in advance.

Moreover, since the empty medicine bottle V and the filled medicine bottle V are transferred between the charging unit 2 and the providing unit 3 via the transfer tables 61, 62, the smooth medicine bottle conveyance can be realized while remarkably simplifying the constitution of the conveying device even in a case where the conveying direction (horizontal direction) of the medicine bottle V to be filled with the medicine is different from that (vertical direction) of the medicine bottle V for providing the medicine.

Here, since two transfer tables are disposed in the present embodiment, the empty medicine bottle V can be laid on the transfer table 61 while the filled medicine bottle V is laid on the transfer table 62. Therefore, the microcomputer 73 allows the conveying device 53 to convey the empty medicine bottle V onto the transfer table 61 irrespective of an operating situation of the conveying device 31 in a case where there is not any empty medicine bottle V on the transfer table 61. Moreover, when the photographing of the filled medicine bottle V on the transfer table 62 is completed, the filled medicine bottle V is conveyed to the lid closing device 58 by the conveying device 53. When the empty medicine bottle V exists on the transfer table 61, the conveying device 31 is moved to hold the empty medicine bottle V and execute an operation of filling the medicine bottle V with the medicine irrespective of the operating situation of the conveying device 53. When there is not any filled medicine bottle V on the transfer table 62, the filled medicine bottle V provided with the label 66 is conveyed onto the transfer table 62 by the conveying device 31.

That is, since the moving of the medicine bottle V (the empty and filled medicine bottles) by the conveying device 53 is performed simultaneously with the moving of the medicine bottle V (the filled and empty medicine bottles) by the conveying device 31, the medicine supply operation can be performed quickly.

It is to be noted that in the present embodiment, the overflow of the medicine is judged using the medicine detecting sensor 37 for use in counting the medicines discharged from the tablet case 9. However, the medicine bottle V is usually molded of a translucent hard synthetic resin. Therefore, when an infrared sensor is disposed right under the upper opening of the medicine bottle V, the infrared sensor can detect the medicine to thereby detect that the medicine is going to overflow. In this case, the infrared sensor needs to be separately disposed unlike the above-described embodiment, but the overflow can be judged before the medicines are raised from the upper opening of the medicine bottle V. This can further improve an overflow preventing effect.

Furthermore, in the present embodiment, an example of filling the medicine bottle with the medicine has been described, but the present invention is not limited to this embodiment, and is also effective for a medicine supply apparatus to fill a cartridge with the medicine.

What is claimed is:

1. A medicine supply apparatus, comprising:

tablet cases;

attaching bases for mounting the tablet cases above an attaching plate, the attaching plate configured to mount all tablet cases in the medicine supply apparatus on a horizontal plane;

a holding device for positioning a medicine bottle and an external driving gear below the tablet cases;

wherein each of the table cases comprises:

a storage container in which medicines are stored;

a discharge drum which is disposed in a bottom part of the storage container and which rotates; and a partitioning member which extends substantially obliquely from one wall of the storage container towards another wall in the storage container and which vertically partitions the inside of the storage container while permitting passage of the medicines; and each of the attaching bases comprises:

a chute for allowing the medicines to discharge from a corresponding tablet case substantially vertically downwards from a groove formed in the discharge drum and an engagement gear that protrudes from a bottom side of the attaching base to engage the external driving gear located on the holding device having a motor that drives the drum, the discharge drum being disposed below the partitioning member, and the engagement gear being disposed below the discharge drum in a vertical direction, wherein the holding device is configured to move horizontally below the attaching plate so as to dispense medicines from each of the tablet cases that are mounted on the attaching plate, the external driving gear engaging an engagement gear of a corresponding tablet case directly below a partitioning member of the corresponding tablet case; and wherein the engagement gear and the chute protrude below the horizontal plane of the attaching plate via an opening provided in the attaching plate such that when the external driving gear moves vertically in order to mate the engagement gear, the holding device places the medicine bottle below the chute.

2. The medicine supply apparatus according to claim 1, wherein each of the table cases further comprises:

a lid which openably closes an opening of the storage container; and a locking mechanism which retains a closed state of the lid.

3. The medicine supply apparatus according to claim 1 or 2, wherein a gap is formed between the discharge drum and the partition member above the chute in a side of the storage container having the one wall when medicines are stored in the storage container of each of the tablet cases.

* * * * *